US009811044B2

(12) United States Patent
Matsumoto et al.

(10) Patent No.: US 9,811,044 B2
(45) Date of Patent: Nov. 7, 2017

(54) IMAGE FORMING APPARATUS

(71) Applicant: CANON KABUSHIKI KAISHA, Tokyo (JP)

(72) Inventors: Hidenori Matsumoto, Kashiwa (JP); Hiroyuki Eda, Moriya (JP); Yuichi Yamamoto, Nagareyama (JP); Naoto Watanabe, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/993,337

(22) Filed: Jan. 12, 2016

(65) Prior Publication Data

US 2016/0216677 A1 Jul. 28, 2016

(30) Foreign Application Priority Data

Jan. 23, 2015 (JP) ..... 2015-010848

(51) Int. Cl.
*G03G 15/00* (2006.01)
*G03G 21/16* (2006.01)

(52) U.S. Cl.
CPC ..... *G03G 15/70* (2013.01); *G03G 21/1638* (2013.01); *G03G 2215/00341* (2013.01)

(58) Field of Classification Search
CPC ..... G03G 15/70
USPC ..... 399/21
See application file for complete search history.

(56) References Cited

U.S. PATENT DOCUMENTS 4,777,498 A 10/1988 Kasamura et al.
4,787,616 A 11/1988 Sasaki et al.
4,799,084 A 1/1989 Koike et al.
5,517,281 A * 5/1996 Miyashiro ..... G03G 21/1638 399/124
5,602,625 A * 2/1997 Okamoto ..... G03G 15/55 399/21
6,011,936 A * 1/2000 Kaneko ..... G03G 15/60 399/124
6,554,270 B2 4/2003 Yamamoto
6,674,991 B2 1/2004 Makino et al.
7,000,915 B2 2/2006 Makino
7,505,714 B2 * 3/2009 Asanuma ..... H04N 1/00519 347/104
8,038,139 B2 10/2011 Nishimura et al.
(Continued)

FOREIGN PATENT DOCUMENTS

JP 2012-078604 A 4/2012

*Primary Examiner* — Anthony Nguyen
(74) *Attorney, Agent, or Firm* — Fitzpatrick, Cella, Harper & Scinto

(57) ABSTRACT

An image forming apparatus, including: a conveyance unit configured to convey a sheet on a conveyance path on which the sheet is conveyed; a first conveyance path opening member configured to open a first portion of the conveyance path; a second conveyance path opening member configured to open a second portion, which is located downstream the first portion, of the conveyance path; a sheet leading edge position detecting unit configured to detect a position of a leading edge of a stopped sheet on the conveyance path; and a determination unit configured to determine, based on a detection result of the sheet leading edge position detecting unit, one of not conveying the stopped sheet, causing the conveyance unit to convey the stopped sheet toward the first portion, and causing the conveyance unit to convey the stopped sheet toward the second portion.

16 Claims, 18 Drawing Sheets

(56) References Cited

U.S. PATENT DOCUMENTS

| | | | | |
|---|---|---|---|---|
| 8,157,255 | B2 | 4/2012 | Nishimura et al. | |
| 9,244,414 | B2 * | 1/2016 | Yamazaki | G03G 15/5012 |
| 2007/0201884 | A1 * | 8/2007 | Yamada | G03G 15/70 399/21 |
| 2010/0074636 | A1 * | 3/2010 | Okano | G03G 15/55 399/21 |
| 2011/0064427 | A1 * | 3/2011 | Yoshida | B65H 43/04 399/21 |
| 2012/0200028 | A1 * | 8/2012 | Shiraishi | B65H 5/062 271/110 |
| 2013/0108284 | A1 * | 5/2013 | Takata | G03G 15/6529 399/21 |
| 2014/0064748 | A1 * | 3/2014 | Yako | G03G 15/0136 399/21 |
| 2014/0079411 | A1 * | 3/2014 | Saitsu | G03G 15/70 399/21 |
| 2014/0219669 | A1 * | 8/2014 | Katsura | B65H 43/06 399/21 |

* cited by examiner

IMAGE FORMING APPARATUS

BACKGROUND OF THE INVENTION

Field of the Invention

The present invention relates to an image forming apparatus configured to convey a stopped sheet to an open portion of a conveyance path.

Description of the Related Art

Image forming apparatus such as a copying machine and a printer are configured to form an image on a recording medium such as a paper sheet (hereinafter referred to as a "sheet"). In each of the image forming apparatus, the sheet is conveyed from a sheet containing portion to a sheet delivery portion through an image forming portion in the inside of the image forming apparatus. When a sheet jam (hereinafter referred to as "jam") has occurred in the inside of the image forming apparatus, it may be difficult for a user to clear the jam depending on a stop position of the jammed sheet.

FIG. 11A and FIG. 11B are explanatory views of jammed sheets in the inside of an image forming apparatus 100. For example, when a jammed sheet P1 is present at a position immediately after sheet feeding as illustrated in FIG. 11A, most of the leading edge of the jammed sheet P1 is not fed out of a first sheet feed cassette 220. In this case, even when a lower door 260 provided on the side surface of a main body 100*a* of the image forming apparatus 100 is opened so as to remove the jammed sheet P1, the user's hand is hard to reach the jammed sheet P1, thereby being difficult to clear the jam.

Incidentally, there is generally known a method of conveying, in the event of the jam, the jammed sheet P1 to a position from which the user can easily clear the jam. When the distance between the jammed sheet P1 and a jammed sheet P2 preceding the jammed sheet P1 is short as illustrated in FIG. 11B, however, the jammed sheet P1 cannot be conveyed because the jammed sheet P1 may hit against the preceding jammed sheet P2 when the jammed sheet P1 is conveyed.

Therefore, according to Japanese Patent Application Laid-Open No. 2012-78604, when the lower door 260 is opened, the jammed sheet P1 is forcedly conveyed by an amount set in advance depending on the size, the type, and the like of the jammed sheet P1. FIG. 12A, FIG. 12B, and FIG. 12C are explanatory views of forced conveyance of the jammed sheet P1 in the related art. FIG. 12A is a view for illustrating a state in which the lower door 260 is opened. FIG. 12B is a view for illustrating the jammed sheet P1 forcedly conveyed in a direction indicated by the arrow A. As illustrated in FIG. 12B, the jammed sheet P1 can forcedly be conveyed to an open space defined by the opened lower door 260. Thus, even when an inter-sheet distance between the trailing edge of the preceding jammed sheet P2 and the leading edge of the jammed sheet P1 is short, the leading edge of the jammed sheet P1 can be conveyed to the position from which the user can easily clear the jam.

Depending on the type or stiffness of the sheet, however, the jammed sheet P1 is forcedly conveyed in a direction indicated by the arrow B as illustrated in FIG. 12C, with the result that the jammed sheet P1 may enter a conveyance path of an upper door 261, which is not opened. As in this case, the related art has a problem in that the jammed sheet P1 may be conveyed to a position where it is even more difficult for a user to clear the jam.

SUMMARY OF THE INVENTION

In view of the above, the present invention provides an image forming apparatus configured to convey a stopped sheet to a position from which a user can easily remove the stopped sheet.

According to one embodiment, there is provided an image forming apparatus, comprising:

a conveyance unit configured to convey a sheet on a conveyance path on which the sheet is conveyed;

a first conveyance path opening member configured to open a first portion of the conveyance path;

a second conveyance path opening member configured to open a second portion, which is located on a downstream side of the first portion, of the conveyance path;

a sheet leading edge position detecting unit configured to detect a position of a leading edge of a stopped sheet on the conveyance path; and a determination unit configured to determine, based on a detection result of the sheet leading edge position detecting unit, one of not conveying the stopped sheet, causing the conveyance unit to convey the stopped sheet toward the first portion, and causing the conveyance unit to convey the stopped sheet toward the second portion.

Further features of the present invention will become apparent from the following description of exemplary embodiments with reference to the attached drawings.

DESCRIPTION OF THE EMBODIMENTS

Now, embodiments of the present invention will be described with reference to the attached drawings.

First Embodiment (Image Forming Apparatus)

Figure 1A:
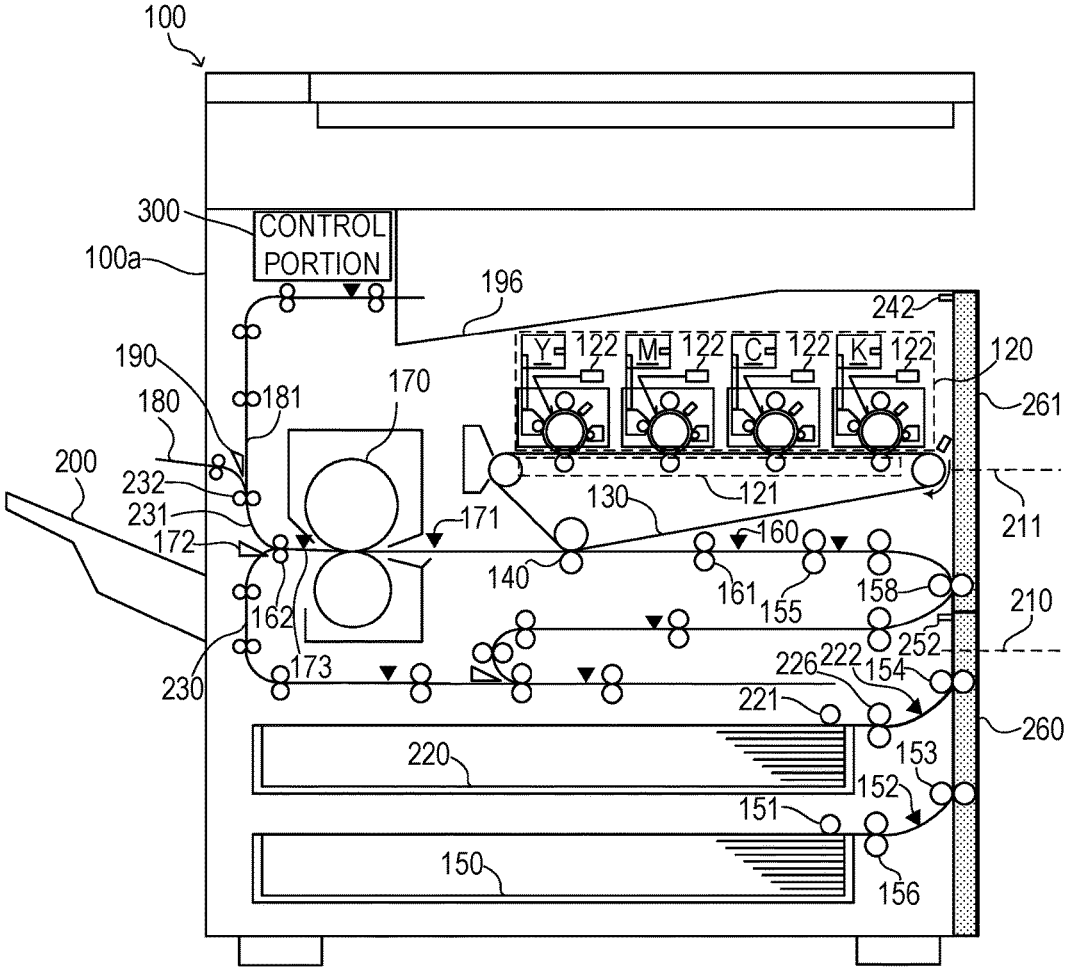
FIGS. 1A and 1B are views for illustrating an image forming apparatus according to a first embodiment.
Figure 1B:
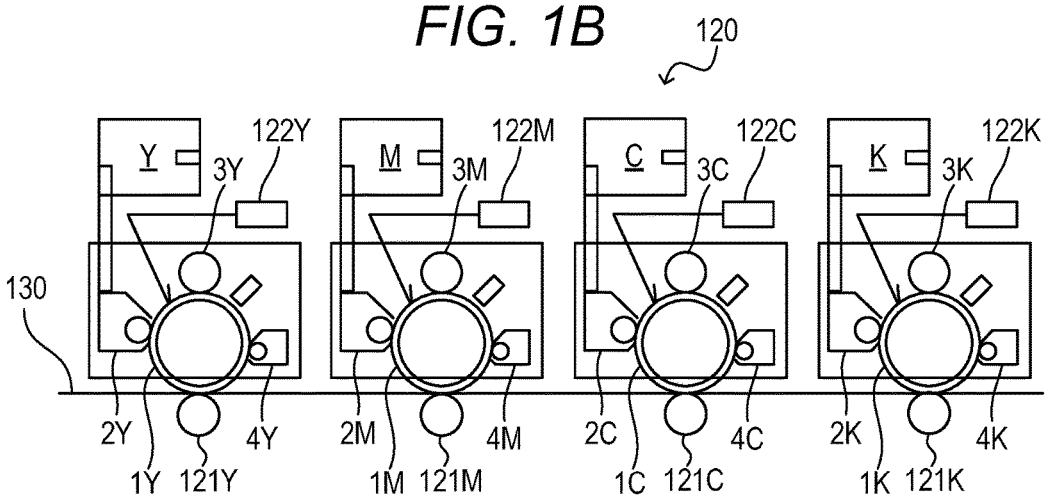

FIG. 1A and FIG. 1B are views for illustrating an image forming apparatus 100 according to a first embodiment. FIG. 1A is a sectional view of the image forming apparatus 100.

Figure 2:
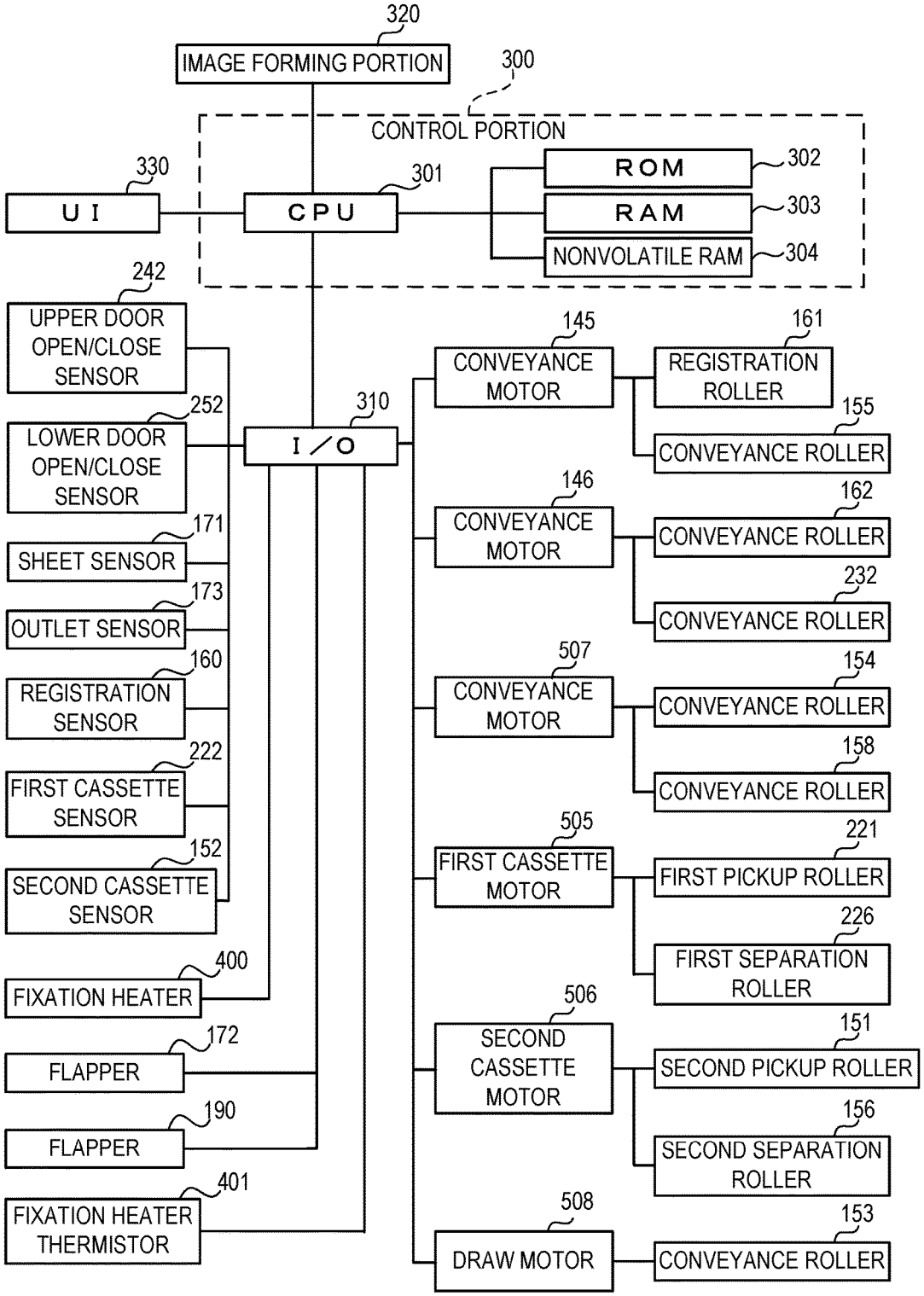
FIG. 2 is a control block diagram of the first embodiment.

FIG. 1B is an enlarged view of a process unit 120 of the image forming apparatus 100. FIG. 2 is a control block diagram of the first embodiment. Referring to FIG. 1A, FIG. 1B, and FIG. 2, the structure of the image forming apparatus 100 will be described.

A control portion 300 and the process unit 120 being a part of an image forming portion are provided in a main body 100*a* of the image forming apparatus 100. A lower door (first conveyance path opening member) 260 and an upper door (second conveyance path opening member) 261, which serve as openable and closable members, are provided in a side wall of the main body 100*a*. The lower door 260 is configured to open a first portion 210 of a conveyance path for conveyance of a recording medium (hereinafter referred to as "sheet") on which an image is to be formed. The first portion 210 corresponds to a position from which a user can easily remove a jammed sheet when the lower door 260 is opened. The upper door 261 is configured to open a second portion 211 of the conveyance path for conveyance of the sheet. The second portion 211 corresponds to a position from which the user can easily remove the jammed sheet when the upper door 261 is opened. A first sheet feed cassette 220 and a second sheet feed cassette 150 each containing the sheets are arranged at a lower portion of the main body 100*a*.

As illustrated in FIG. 2, the control portion 300 includes a CPU 301, a ROM (storage portion) 302, a RAM (storage portion) 303, and a nonvolatile RAM (storage portion) 304. The CPU 301 is electrically connected to a conveyance motor 145, a conveyance motor 146, and a conveyance motor 507 via an I/O 310. The CPU 301 is electrically connected to a first cassette motor 505, second cassette motor 506, and a draw motor 508 via the I/O 310 as well. The conveyance motor 145 is configured to drive registration rollers 161 and conveyance rollers 155. The conveyance motor 146 is configured to drive conveyance rollers 162 and conveyance rollers 232. The conveyance motor 507 is configured to drive conveyance rollers 154 and conveyance rollers 158. The first cassette motor 505 is configured to drive a first pickup roller 221 and first separation rollers 226 independently of each other. The second cassette of 506 is configured to drive a second pickup roller 151 and second separation rollers 156 independently of each other. The draw motor 508 is configured to drive conveyance rollers 153.

An instruction to start a printing operation is input to the CPU 301 via, for example, a user interface (hereinafter referred to as "UI") 330 serving as an operation portion. When the CPU 301 receives the instruction to start the printing operation, the CPU 301 controls the conveyance motor 145, the conveyance moor 146, the conveyance motor 507, the first cassette motor 505, the second cassette motor 506, and the draw motor 508.

The CPU 301 is electrically connected to an upper door open/close sensor second conveyance path opening detecting unit) 242 and a lower door open/close sensor (first conveyance path opening detecting unit) 252 via the I/O 310. The upper door open/close sensor 242 is configured to output, to the CPU 301, a detection signal indicating whether the upper door 261 is opened or not. The lower door open/close sensor 252 is configured to output, to the CPU 301, a detection signal indicating whether the lower door 260 is opened or not. The CPU 301 is electrically connected to a sheet sensor 171, an outlet sensor 173, a registration sensor 160, a first cassette sensor 222, and a second cassette sensor 152 via the I/O 310. The sheet sensor 171, the outlet sensor 173, the registration sensor 160, the first cassette sensor 222, and the second cassette sensor 152 each function as a sheet detecting unit configured to detect the sheet on the conveyance path. The sheet detecting unit is configured to output, to the CPU 301, a detection signal indicating whether the sheet is present on the conveyance path or not.

Further, the CPU 301 is configured to control an image forming portion 320. The image forming portion 320 is configured to control the process unit. 120, a transfer belt (intermediate transfer member) 130, a secondary transfer portion 140, and laser scanner units (light scanning devices) 122 illustrated in FIG. 1A and FIG. 1B. Still further, the CPU 301 is electrically connected to a fixation heater 400, a flapper 172, a flapper 190, and a fixation heater thermistor 401 via the I/O 310. The fixation heater 400 is provided to a fixing device 170, and is configured to heat the fixing device 170. The fixation heater thermistor 401 is configured to detect the temperature of the fixation heater 400. The CPU 301 controls the fixation heater 400 based on the temperature detected by the fixation heater thermistor 401.

(Image Forming Operation)

Next, referring to FIG. 1A, FIG. 1B, and FIG. 2, an image forming operation of the image forming apparatus 100 will be described. When the CPU 301 receives the instruction to start the printing operation via the UI 330, the CPU 301 drives the second cassette motor 506 via the I/O 310 to rotate the second pickup roller 151 and the second separation rollers 156. The second pickup roller 151 and the second separation rollers 156 feed the sheets in the second sheet feed cassette 150 one by one. At this time, based on the detection signal received from the second cassette sensor 152, the CPU 301 determines whether the sheet feed operation has been performed normally or not.

On the other hand, the CPU 301 starts the image forming operation by the process unit 120 so that images reach the secondary transfer portion 140 in synchronization with the timing when the sheet reaches the secondary transfer portion 140. The process unit 120 includes four process units 120Y, 120M, 120C, and 120K as illustrated in FIG. 1E. The four process units 120Y, 120M, 120C, and 120K have the same structure except that the process units 120Y, 120M, 120C, and 120K contain yellow toner (developer) Y, magenta toner (developer) M, cyan toner (developer) C, and black toner (developer) K, respectively. Each process unit 120 includes a photosensitive drum 1 (1Y, 1M, 1C, 1K). A developing device 2 (2Y, 2M, 2C, 2K), a charging roller 3 (3Y, 3M, 3C, 3K), and a photosensitive drum cleaner (4Y, 4M, 4C, 4K) are arranged around the photosensitive drum 1. The charging roller 3 uniformly charges the surface of the photosensitive drum 1. The laser scanner unit 122 (122Y, 122M, 122C, 122K) emits laser light onto the uniformly charged surface of the photosensitive drum 1 to form a latent image on the surface of the photosensitive drum 1. The developing device 2 develops the latent image on the surface of the photosensitive drum 1 with the toner (Y, M, C, K) contained in the developing device 2 to form a toner image. A primary transfer voltage is applied to a primary transfer portion 121 (121Y, 121M, 121C, 121K) to transfer the toner image on the photosensitive drum 1 onto the transfer belt 130. The toner image on the transfer belt 130 is conveyed to the secondary transfer portion 140 through rotation of the transfer belt 130.

Based on the detection signal received from the registration sensor 160, the CPU 301 detects the position of the sheet conveyed by the conveyance rollers 153, the conveyance rollers 154, the conveyance rollers 158, and the conveyance rollers 155. Based on the detection signal received from the registration sensor 160, the CPU 301 controls the conveyance of the sheet so that the leading edge of the sheet is in alignment with the leading edge of the toner image on the transfer belt 130 at the secondary transfer portion 140. For example, when the sheet has reached earlier than the toner image, the CPU 301 causes the registration rollers 161 to stop the sheet for a predetermined period of time, and then resumes the conveyance in synchronization with the timing of the toner image.

When a secondary transfer voltage is applied to the secondary transfer portion 140, the toner image is transferred onto the sheet at the secondary transfer portion 140. The sheet on which the toner image has been transferred is conveyed to the fixing device 170. The fixing device 170 heats and pressurizes the sheet to thermally fix the toner image onto the sheet. When the leading edge of the sheet after the fixation has reached the outlet sensor 173, based on an instruction received via the UI 330, the CPU 301 determines of a sheet conveyance path 230 and a sheet conveyance path 231 to which the sheet is to be conveyed. The CPU 301 switches the flapper 172 to switch the sheet conveyance destination between the sheet conveyance path 230 and the sheet conveyance path 231. Specifically, when an instruction for duplex printing is issued, the sheet is conveyed to the sheet conveyance path 230, whereas when an instruction for simplex printing is issued or when an image is formed on a back surface of the sheet during the duplex printing, the sheet is conveyed to the sheet conveyance path 231.

The sheet conveyed to the sheet conveyance path 231 is further conveyed toward the downstream side by the conveyance rollers 232. The CPU 301 switches the flapper 190 based on an instruction received via the UI 330 to convey the sheet to a sheet conveyance path 180 or a sheet conveyance path 181. When the sheet delivery destination designated by the user is a sheet delivery tray 200, the sheet is conveyed to the sheet conveyance path 180, whereas when the sheet delivery destination designated by the user is a sheet delivery tray 196, the sheet is conveyed to the sheet conveyance path 181. Note that, the above-mentioned image forming apparatus 100 is only an example, and the present invention is not limited to the above-mentioned image forming apparatus 100.

(Jam Detection)

Figure 3A:
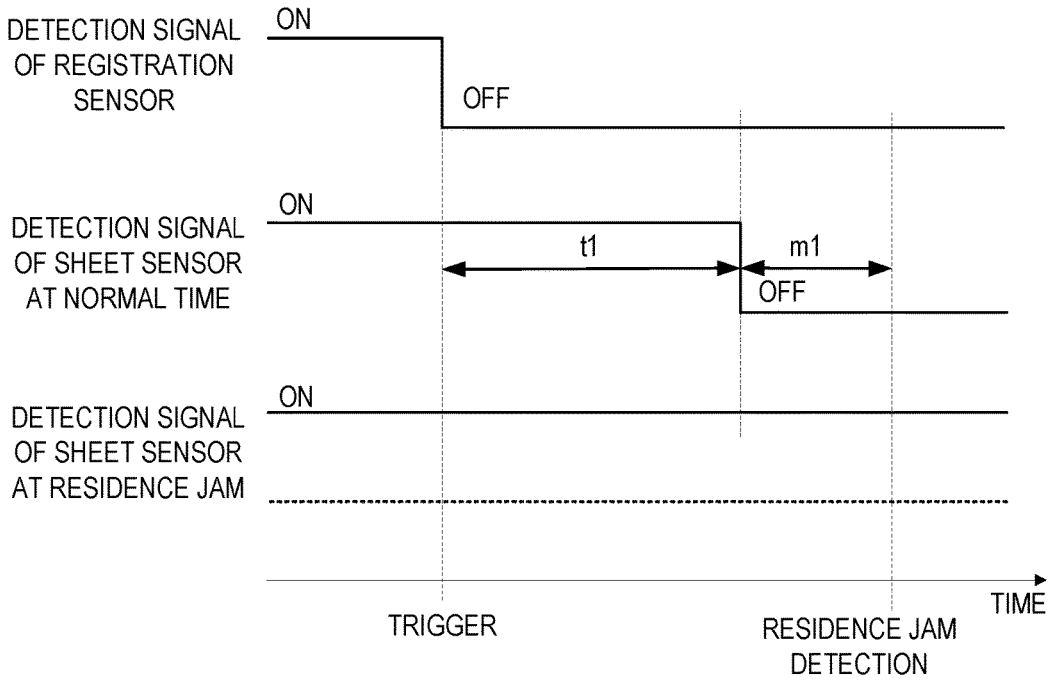
FIGS. 3A and 3B are explanatory diagrams of jam detection.
Figure 3B:
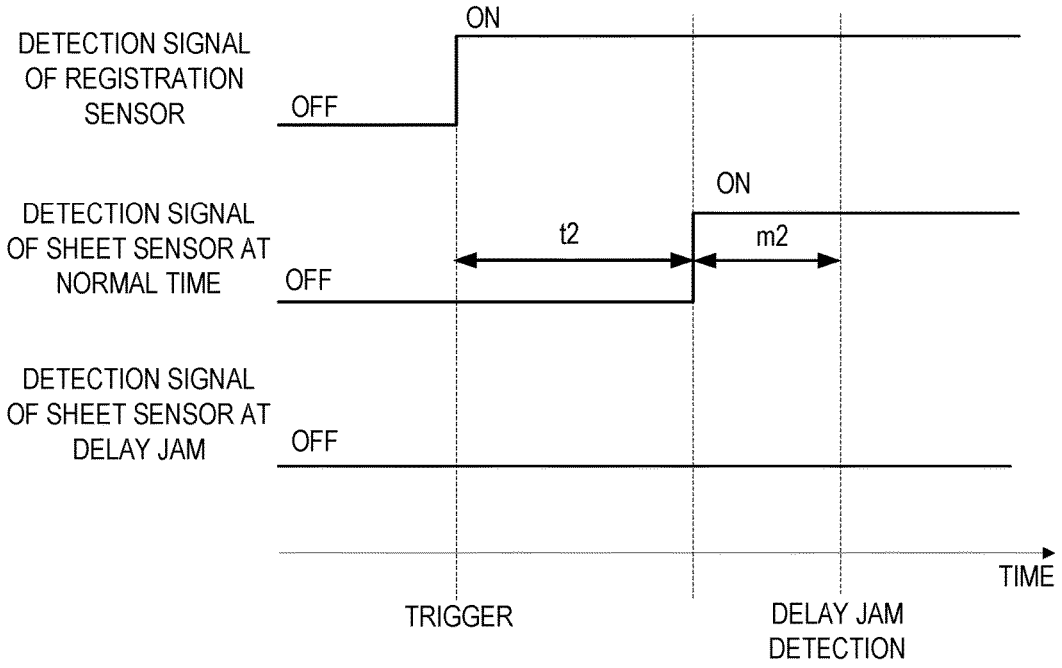

Next, referring to FIG. 3A and FIG. 3B, jam detection for detecting a sheet jam (hereinafter referred to as "jam") will be described. FIG. 3A and FIG. 3B are explanatory diagrams of the lam detection. FIG. 3A is an explanatory diagram of residence jam detection. FIG. 3B is an explanatory diagram of delay jam detection. As one example, FIG. 3A and FIG. 3B are timing sequence diagrams for illustrating detection signals of the registration sensor 160 and detection signals of the sheet sensor 171 arranged on the downstream side of the registration sensor 160. FIG. 3A and FIG. 3B are illustrations of an example of residence of the sheet (residence jam) and delay of the sheet (delay jam) at the location of the sheet sensor 171. The residence jam refers to a jam occurring when the sheet that is supposed to pass through the location of the sheet sensor 171 within a predetermined period of time has not passed yet even after the elapse of the predetermined period of time. The delay jam refers to a jam occurring when the sheet that is supposed to reach the location of the sheet sensor 171 within a predetermined period of time has not reached yet even after the elapse of the predetermined period of time. The CPU 301, the registration sensor 160, the sheet sensor 171, the outlet sensor 173, the first cassette sensor 222, and the second cassette sensor 152 each function as a jam detecting unit configured to detect whether the jam has occurred or not.

First, referring to FIG. 3A, the residence jam detection to be performed by the sheet sensor 171 will be described. The residence jam detection is triggered when the control portion 300 has detected the passage of the trailing edge of the sheet with the registration sensor 160 during the sheet conveyance. In response to the trigger, a time t1 required for the trailing edge of the sheet to pass through the location of the sheet sensor 171 is determined based on a distance between the registration sensor 160 and the sheet sensor 171 and the sheet conveyance speed. The conveyance efficiency may be degraded due to the wear of the registration rollers 161 or the structure of the conveyance mechanism itself. When a period of time set in consideration of delay caused by the degradation of the conveyance efficiency is defined as "conveyance margin m1", it is predicted that at most a time t1+m1 is required for the trailing edge of the sheet to pass through the region from the registration sensor 160 to the sheet sensor 171. Thus, when the passage of the trailing edge of the sheet cannot be detected by the sheet sensor 171 even though the time t1+m1 has elapsed since the time of the trigger, the CPU 301 determines that the residence jam has occurred. When the CPU 301 determines that the residence jam has occurred, the CPU 301 stops the drive of each motor to stop the conveyance of the sheet.

Next, referring to FIG. 3B, the delay jam detection to be performed by the sheet sensor 171 will be described. The delay jam detection is triggered when the control portion 300 has detected the passage of the leading edge of the sheet (detected the presence of the sheet in a state of detecting the absence of the sheet) with the registration sensor 160 during the sheet conveyance. In response to the trigger, a time t2 required for the leading edge of the sheet to pass through the location of the sheet sensor 171 is determined based on the distance between the registration sensor 160 and the sheet sensor 171 and the sheet conveyance speed. The conveyance efficiency may be degraded due to the wear of the registration rollers 161 or the structure of the conveyance mechanism itself. When a period of time set in consideration of delay caused by the degradation of the conveyance efficiency is defined as "conveyance margin m2", it is predicted that at most a time t2+m2 is required for the leading edge of the sheet to pass through the region from the registration sensor 160 to the sheet sensor 171. Thus, when the passage of the leading edge of the sheet cannot be detected by the sheet sensor 171 even though the time t2+m2 has elapsed since the time of the trigger, the CPU 301 determines that the delay jam has occurred. When the CPU 301 determines that the delay jam has occurred, the CPU 301 stops the drive of each motor to stop the conveyance of the sheet.

Note that, the above-mentioned determination of the jam detection only an example, and the present invention is not limited to the above-mentioned jam detecting method.

Figure 4A:
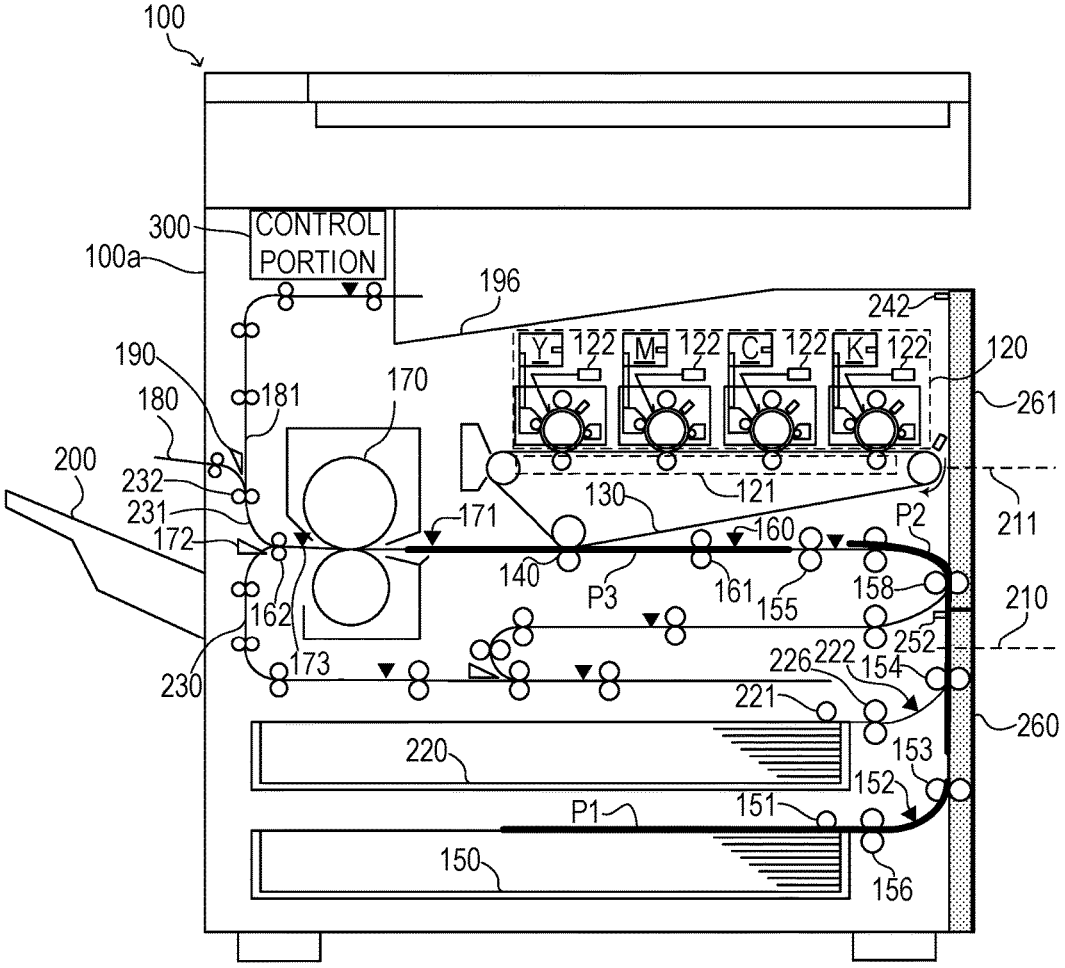
FIGS. 4A and 4B are explanatory views of sheet conveyance after the jam detection.
Figure 4B:
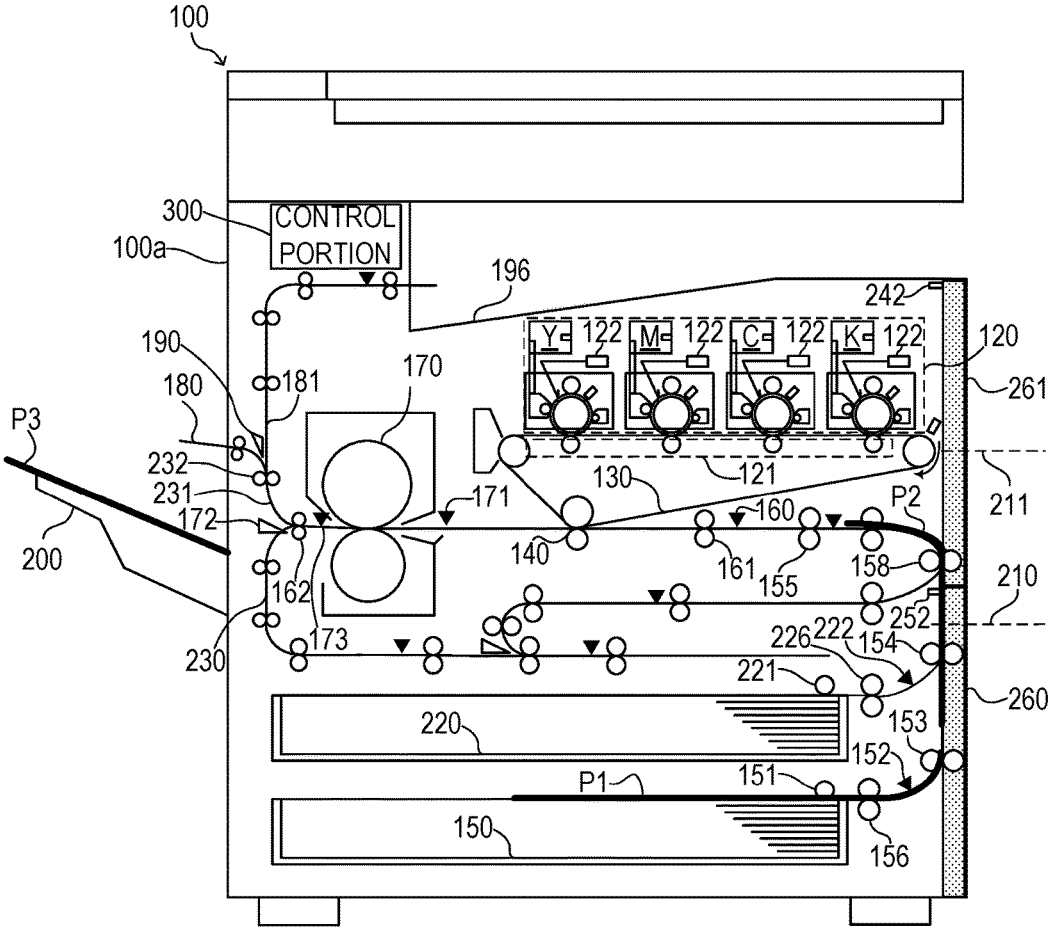

FIG. 4A and FIG. 45 are explanatory views of sheet conveyance after the jam detection. FIG. 4A is a view for illustrating the positions of sheets P1, P2, and P3 when the delay jam or the residence jam has occurred. FIG. 4B is a view for illustrating delivery of the preceding sheet P3 after the delay jam or the residence jam has occurred. When the delay jam or the residence jam is detected and when the sheet P2 illustrated in FIG. 4A is a jam causing sheet, the CPU 301 stops, as jammed sheets, the jam causing sheet P2 and the fed sheet P1 located on the upstream side of the jam causing sheet P2. The CPU 301 continues the normal conveyance of the preceding sheet P3 located on the downstream side of the jam causing sheet P2 to deliver the preceding sheet P3 out of the apparatus as illustrated in FIG. 4B.

When the processing of the sheets to be conveyed in the inside of the main body 100*a* (normal delivery of the sheet out of the apparatus and stop of the conveyance of the jammed sheets) is finished, the CPU 301 displays, on a display portion 340 of the UI 330 (FIG. 7A and FIG. 7B), a screen for prompting the user to clear the jam. In this case, based on the stop position of the jammed sheet (stopped sheet) P1, the CPU 301 determines whether jammed-sheet forced-conveying control described later is performed or not.

(Determination of Whether Jammed-Sheet Forced-Conveying Control is Performed or Not)

Now, referring to FIG. 5, FIG. 6A, FIG. 6B, and FIG. 6C, processing of the determination to be performed by the CPU 301 as to whether the jammed-sheet forced-conveying control is performed or not will be described. When plurality of jammed sheets (stopped sheets) are present in the event of the jam, the CPU 301 determines whether the jammed-sheet forced-conveying control is performed for each of the plurality of jammed sheets or not. Further, referring to FIG. 7A and FIG. 7B, screens of the jam clearance procedure to be displayed on the display portion 340 of the UI 330 will be described.

Figure 5:
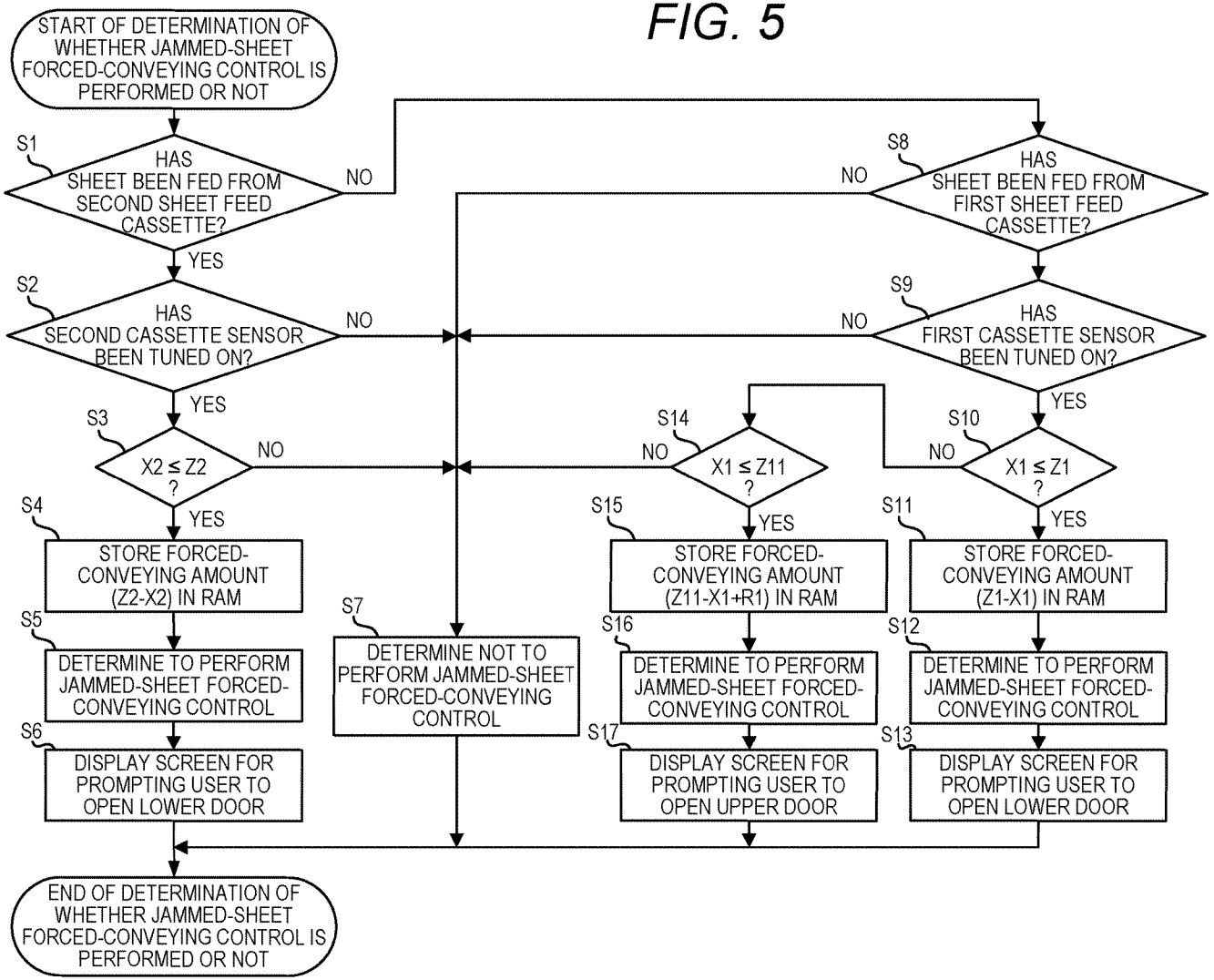
FIG. 5 is a flowchart of determination to be performed by a CPU as to whether jammed-sheet forced-conveying control is performed or not.

FIG. 5 is a flowchart of the determination to be performed by the CPU 301 as to whether the jammed-sheet forced-conveying control is performed or not. Based on a program stored in the ROM 302, the CPU 301 executes control operation for determining whether the jammed-sheet forced-conveying control is performed or not. When the CPU 301 has detected the occurrence of the jam based on the output from each of the sensors arranged on the sheet conveyance path, the CPU 301 starts the determination of whether the jammed-sheet forced-conveying control is performed or not. First, the CPU 301 determines whether the sheet stopped in the event of the jam is a sheet fed from the second sheet feed cassette 150 or not (S1). When the CPU 301 determines that the stopped sheet is the sheet fed from the second sheet feed cassette 150 ("YES" in S1), the CPU 301 determines whether the second cassette sensor 152 is turned ON or not (S2). When the second cassette sensor 152 is not turned ON ("NO" in S2), the stopped sheet is in a state of being usable in a subsequent job without a need for removal from the conveyance path. Therefore, the CPU 301 does, not determine the stopped sheet as a jammed sheet, namely a sheet whose jam is required to be cleared. Thus, in this case, the CPU 301 determines not to perform the jammed-sheet forced-conveying control (S7). The CPU 301 ends the determination of whether the jammed-sheet forced-conveying control is performed or not.

Figure 6A:
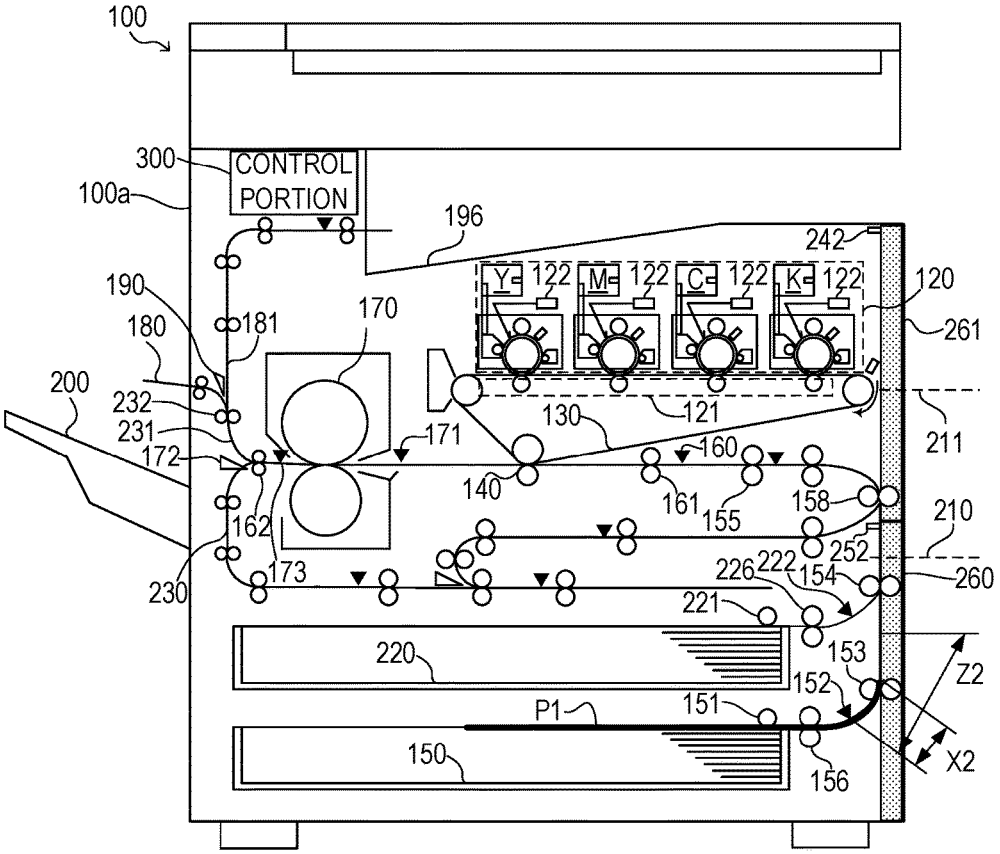
FIGS. 6A, 6B and 6C are explanatory views of forced-conveying amounts of a jammed sheet.
Figure 6B:
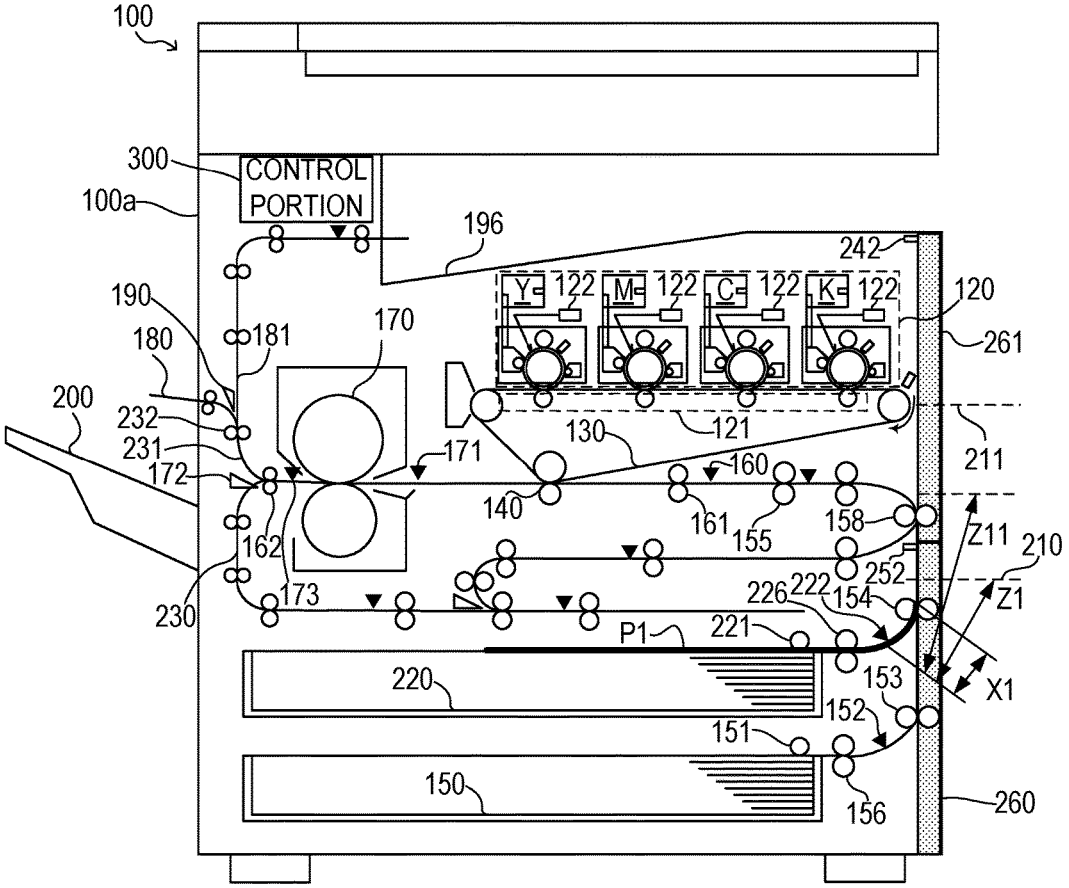
Figure 6C:
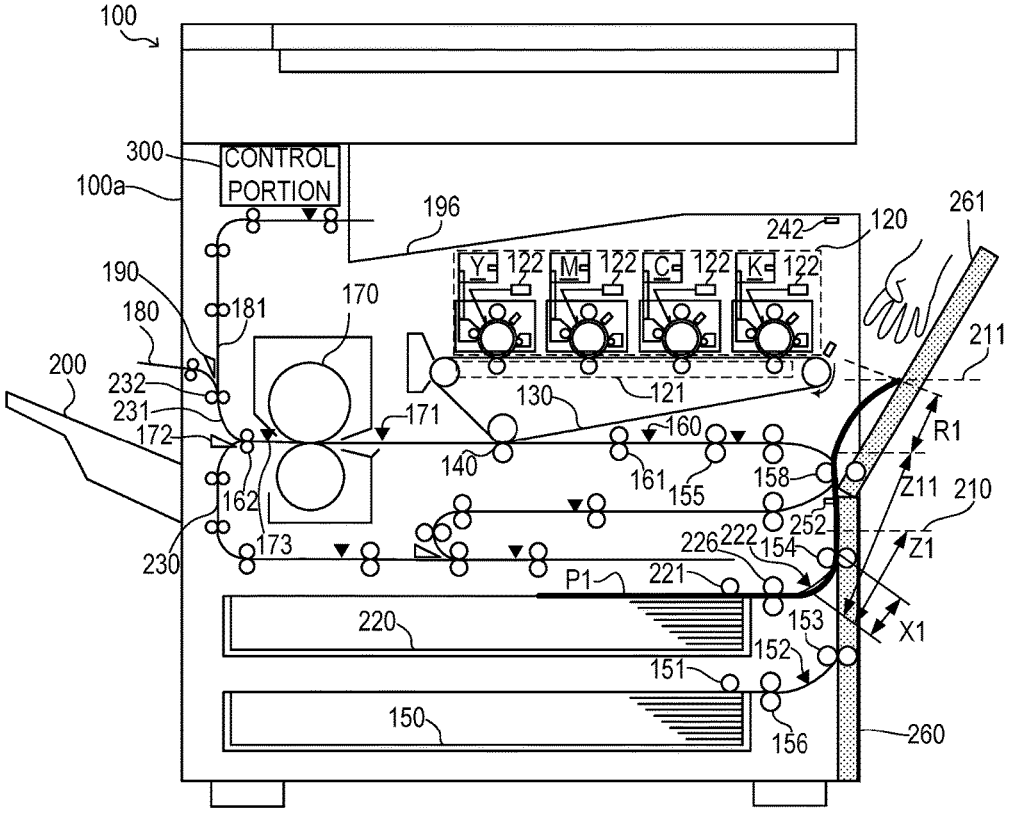
Figure 7A:
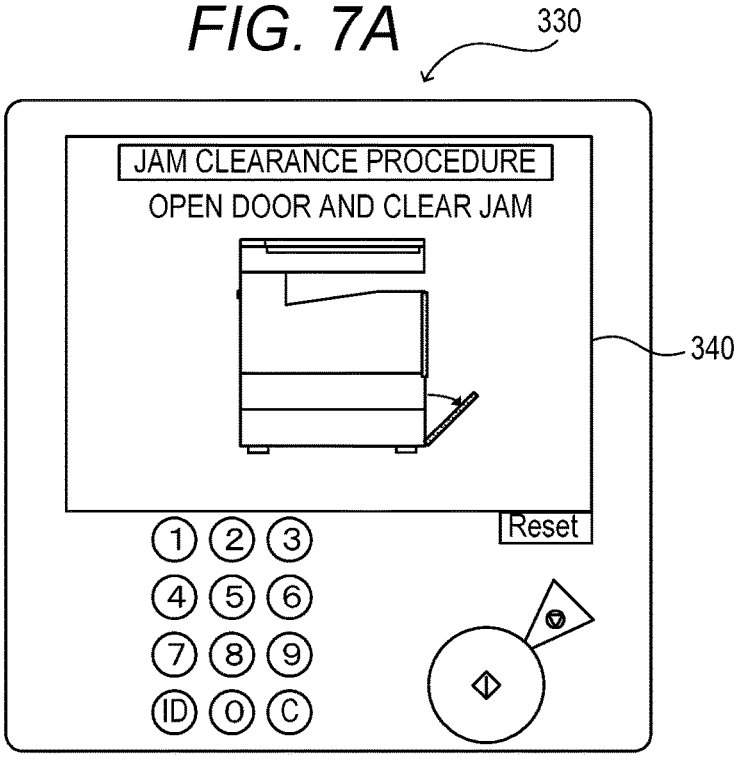
FIGS. 7A and 7B are views for illustrating a lam clearance procedure displayed on a display portion of a UI.
Figure 7B:
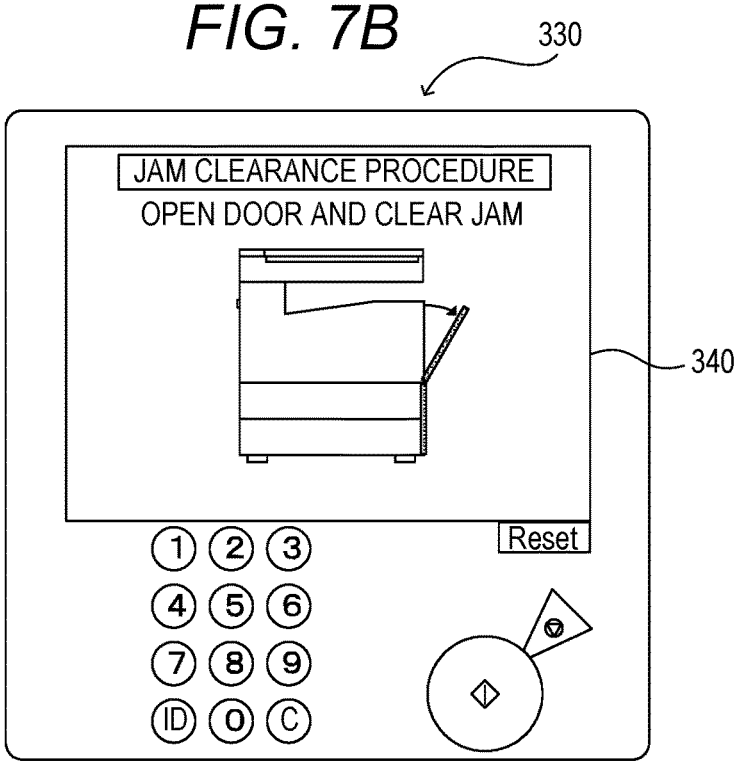

When the second cassette sensor 152 is turned ON ("YES" in S2), on the other hand, the CPU 301 determines the stopped sheet as the jammed sheet P1, namely the sheet whose jam is required to be cleared. FIG. 6A, FIG. 6B, and FIG. 6C are explanatory views of forced-conveying amounts of the jammed sheet P1. The CPU 301 determines whether the leading edge of the jammed sheet P1 has been conveyed from the second cassette sensor 152 to the downstream side by a second predetermined distance Z2 or more as illustrated in FIG. 6A or not. The second predetermined distance 22 refers to a distance between the second cassette sensor 152 and a position where the user can easily grip the leading edge of the jammed sheet P1 when the lower door 260 is opened, and is set in advance. A distance X2 from the second cassette sensor 152 to the leading edge of the jammed sheet. P1 is determined based on the sheet conveyance speed with the detection of the passage of the leading edge of the sheet by the second cassette sensor 152 as a trigger. That is, the second cassette sensor 152 and the CPU 301 each serve as a sheet leading edge position detecting unit configured to determine the distance X2 from the second cassette sensor 152 to the leading edge of the jammed sheet P1. Based on the detection result of the sheet leading edge position detecting unit (distance X2), the CPU 301 determines whether the leading edge of the jammed sheet P1 is located at a position satisfying X2≤Z2 or not (S3). When X2≤Z2 is satisfied ("YES" in S3), the CPU 301 decides the forced-conveying amount (distance) of the jammed sheet P1 as (Z2−X2). The CPU 301 functions as a conveying amount deciding portion configured to decide the conveying amount (conveying distance) of the jammed sheet P1. The CPU 301 stores the forced-conveying amount (Z2−X2) in the RAM 303 (S4). The CPU 301 determines to perform the jammed-sheet forced-conveying control (S5). FIG. 7A and FIG. 7B are views for illustrating a jam clearance procedure displayed on the display portion 340 of the UI 330. To notify the user of the jam clearance procedure, the CPU 301 displays, on the display portion 340 of the UI 330, a screen for prompting the user to open the lower door 260 as illustrated in FIG. 7A (S6). The CPU 301 ends the determination of whether the jammed-sheet forced-conveying control is performed or not.

When the CPU 301 determines that the leading edge of the jammed sheet P1 is not located at the position satisfying X2≤Z2 ("NO" in S3), the leading edge of the sheet P1 has already been conveyed to a position past a position where it is difficult for the user to remove the lammed sheet P1 from the main body 100*a*. Thus, in this case, the CPU 301 decides not to perform the jammed-sheet forced-conveying control (S7). The CPU 301 ends the determination of whether the jammed-sheet forced-conveying control is performed or not.

When the CPU 301 determines that the sheet stopped in the event of the lam is not the sheet fed from the second sheet feed cassette 150 ("NO" in S1), the CPU 301 determines whether the stopped sheet is a sheet fed from the first sheet feed cassette 220 or not (S8). When the CPU 301 determines that the stopped sheet is not the sheet fed from the first sheet feed cassette 220 ("NO" in S8), the sheet is not a sheet fed from a sheet feed stage for which the forced-conveying control is to be performed, and hence the CPU 301 determines not to perform the jammed-sheet forced-conveying control (S7). The CPU 301 ends the determination of whether the jammed-sheet forced-conveying control is performed or not.

When the CPU 301 determines that the stopped sheet is the sheet fed from the first sheet feed cassette 220 ("YES" in S8), the CPU 301 determines whether the first cassette sensor 222 is turned ON or not (S9). When the first cassette sensor 222 is not turned ON ("NO" in S9), the stopped sheet is in a state of being usable in a subsequent job without a need for removal from the conveyance path. Therefore, the CPU 301 does not determine the stopped sheet as a jammed sheet, namely a sheet whose jam is required to be cleared. Thus, in this case, the CPU 301 determines not to perform the jammed-sheet forced-conveying control (S7). The CPU 301 ends the determination of whether the jammed-sheet forced-conveying control is performed or not.

When the first cassette sensor 222 is turned ON ("YES" in S9), on the other hand, the CPU 301 determines the stopped sheet as the jammed sheet P1, namely the sheet whose jam is required to be cleared. The CPU 301 determines whether the leading edge of the jammed sheet P1 has been conveyed from the first cassette sensor 222 to the downstream side by a first predetermined distance Z1 or more as illustrated in FIG. 6B or not. The first predetermined distance Z1 refers to a distance between the first cassette sensor 222 and the position where the user can easily grip the leading edge of the jammed sheet P1 when the lower door 260 is opened, and is set in advance. The first predetermined distance Z1 corresponds to the first portion 210. When the leading edge of the jammed sheet P1 is conveyed to the first portion 210, the user can easily remove the jammed sheet P1. A distance X1 from the first cassette sensor 222 to the leading edge of the jammed sheet P1 is determined based on the sheet conveyance speed with the detection of the passage of the leading edge of the sheet by the first cassette sensor 222 as a trigger. That is, the first cassette sensor 222 and the CPU 301 each serve as the sheet leading edge position detecting unit configured to determine the distance X1 from the first cassette sensor 222 to the leading edge of the jammed sheet P1. Based on the detection result of the sheet leading edge position detecting unit (distance X1), the CPU 301 determines whether the leading edge of the jammed sheet P1 is located at a position satisfying X1≤Z1 or not (S10). When X1≤Z2 is satisfied ("YES" in S10), the CPU 301 decides the forced-conveying amount (distance) of the jammed sheet P1 as (Z1−X1). The CPU 301 functions as the conveying amount deciding portion configured to decide the conveying amount (conveying distance) of the jammed sheet P1. The CPU 301 stores the forced-conveying amount (Z1−X1) in the RAM 303 (S11). The CPU 301 determines to perform the jammed-sheet forced-conveying control (S12). To notify the user of the jam clearance procedure, the CPU 301 displays, on the display portion 340 of the UI 330, the screen for prompting the user to open the lower door 260 as illustrated in FIG. 7A (S13).

The CPU 301 ends the determination of whether the jammed-sheet forced-conveying control is performed or not.

When the CPU 301 determines that the position of the leading edge of the jammed sheet P1 does not satisfy X1≤Z1 ("NO" in S10), the CPU 301 determines whether the leading edge of the jammed sheet P1 is located at a position satisfying X1≤Z11 (Z1<Z11) or not (S14). When Z1≤Z11 is satisfied ("YES" in S14), the CPU 301 decides the forced-conveying amount (distance) of the jammed sheet P1 as (Z11−X1+R1). The CPU 301 functions as the conveying amount deciding portion configured to decide the conveying amount (conveying distance) of the jammed sheet P1. The CPU 301 stores the forced-conveying amount (Z11−X1+R1) in the RAM 303 (S15). The CPU 301 determines to perform the jammed-sheet forced-conveying control (S16). To notify the user of the lam clearance procedure, the CPU 301 displays, on the display portion 340 of the UI 330, a screen for prompting the user to open the upper door 261 as illustrated in FIG. 7B (S17). The CPU 301 ends the determination of whether the jammed-sheet forced-conveying control is performed or not.

The distance (Z11+R1) from the first cassette sensor 222 refers to a distance between the first cassette sensor 222 and a position where the user can easily grip the leading edge of the jammed sheet P1 when the upper door 261 is opened, and is set in advance. As illustrated in FIG. 6C, the distance (Z11+R1) corresponds to the second portion 211. When the leading edge of the jammed sheet P1 is conveyed to the second portion 211, the user can easily remove the jammed sheet P1. It is only necessary that the distance R1 be, for example, a variable which may be set by the user via the UT 330. The distance R1 may be set so that the jammed sheet P1 is forcedly conveyed to the position from which the user can easily remove the jammed sheet P1 when the upper door 261 is opened.

When X1≤Z11 is not satisfied ("NO" in S14), the leading edge of the sheet P1 has already been conveyed to a position past a position where it is difficult for the user to remove the jammed sheet P1 from the main body 100*a*. Thus, the CPU 301 determines not to perform the jammed-sheet forced-conveying control (S7). The CPU 301 ends the determination of whether the jammed-sheet forced-conveying control is performed or not.

As described above, the CPU 301 functions as a determination unit configured to determine, based on the detection result of the sheet leading edge position detecting unit, whether not to convey the jammed sheet P1, whether to convey the jammed sheet P1 toward the first portion 210, or whether to convey the jammed sheet P1 toward the second portion 211.

(Jammed-Sheet Forced-Conveying Control)

Figure 8:
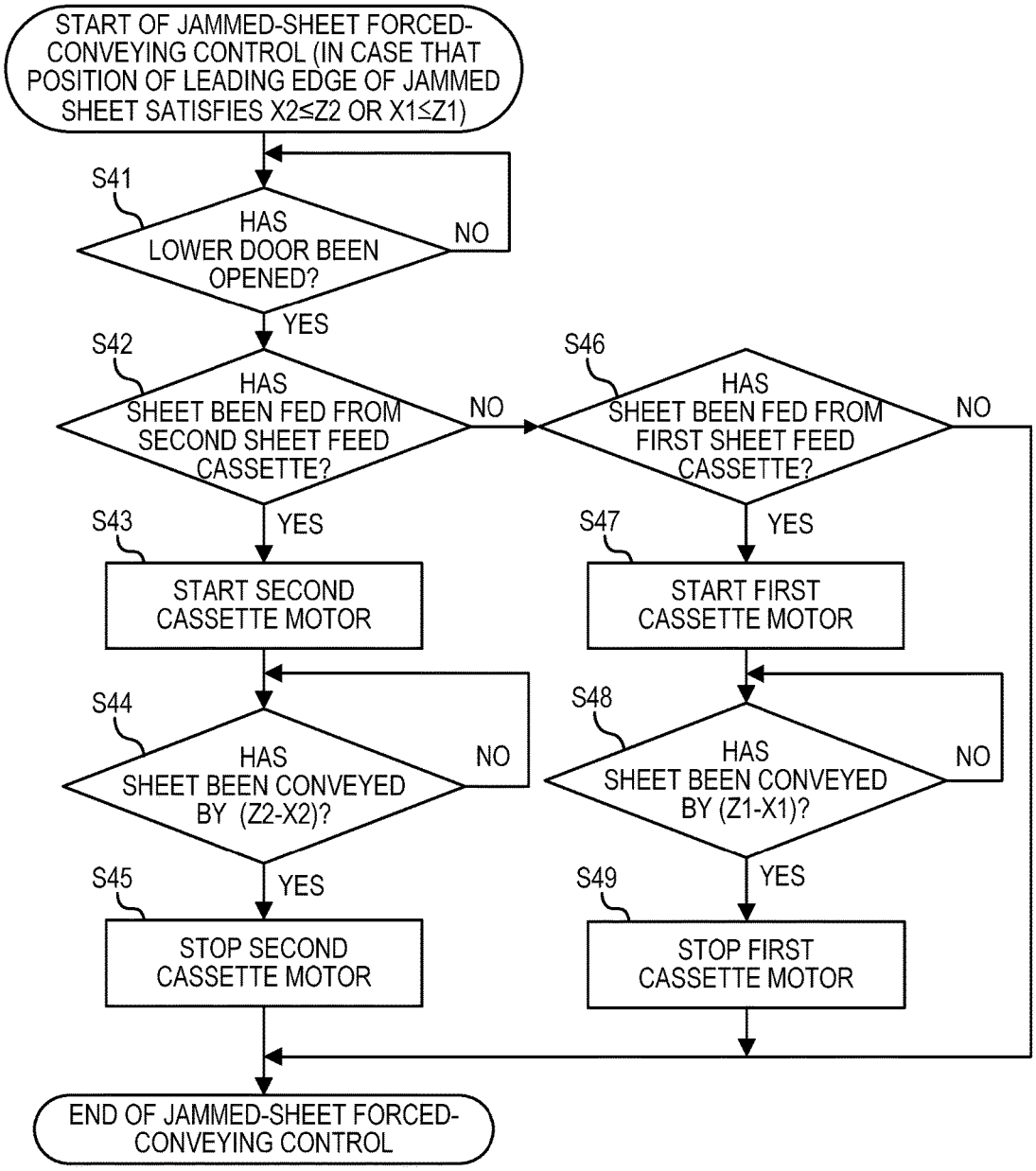
FIG. 8 is a flowchart of jammed-sheet forced-conveying control to be performed when a lower door is to be opened.
Figure 9:
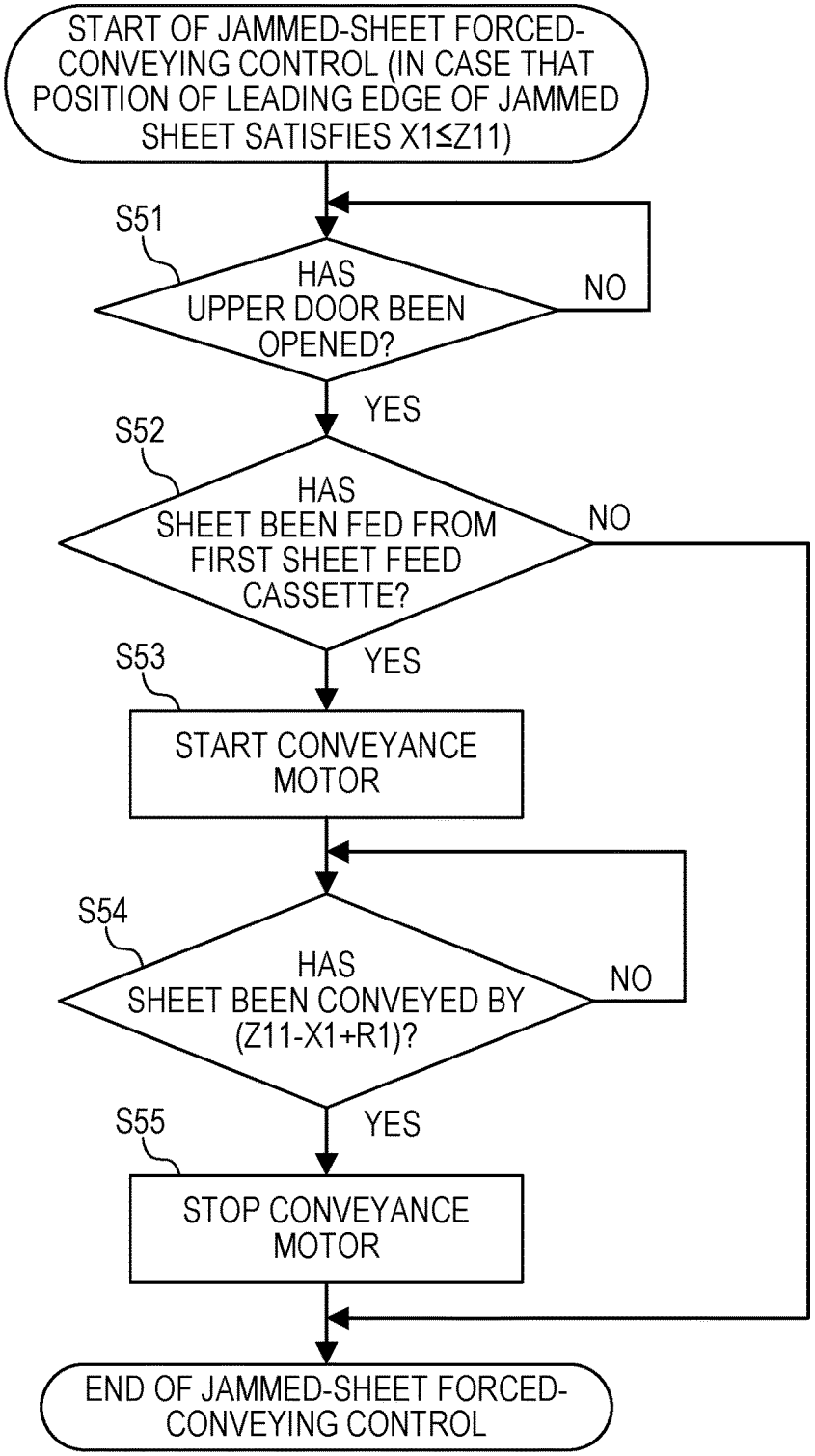
FIG. 9 is a flowchart of jammed-sheet forced-conveying control to be performed when an upper door is to be opened.

Next, referring to FIG. 8 and FIG. 9, the jammed-sheet forced-conveying control will be described. FIG. 8 is a flowchart of the jammed-sheet forced-conveying control to be performed when the lower door 260 is to be opened. FIG. 9 is a flowchart of the jammed-sheet forced-conveying control to be performed when the upper door 261 is to be opened.

First, referring to FIG. 8, the jammed-sheet forced-conveying control to be performed when the lower door 260 is to be opened will be described. When it is determined that X2≤Z2 is satisfied in Step 33 of FIG. 5 and the screen for prompting the user to open the lower door 260 is displayed in Step S6 of FIG. 5, or when it is determined that X1≤Z1 is satisfied in Step S10 of FIG. 5 and the screen for prompting the user to open the lower door 260 is displayed in Step S13 of FIG. 5, the jammed-sheet forced-conveying control illustrated in FIG. 8 is started. The CPU 301 executes the jammed-sheet forced-conveying control based on the program stored in the ROM 302. When the leading edge of the jammed sheet P1 is located at the position satisfying X2≤Z2 or X1≤Z1, the CPU 301 determines whether the lower door open/close sensor 252 configured to detect the opening or closing of the lower door 260 is turned OFF or not (S41). The lower door open/close sensor 252 is a push switch. When the lower door open/close sensor 252 is turned ON, the CPU 301 determines that the lower door 260 is closed. When the lower door open/close sensor 252 is turned OFF, the CPU 301 determines that the lower door 260 is opened. That is in Step S41, the CPU 301 determines whether the lower door 260 is opened or not. The CPU 301 waits until the lower door 260 is opened ("NO" in S41).

When the lower door 260 is opened ("YES" in S41), the CPU 301 determines whether the jammed sheet P1 is the sheet fed from the second sheet feed cassette 150 or not (S42). When the jammed sheet P1 is the sheet fed from the second sheet feed cassette 150 ("YES" in S42), the CPU 301 starts the drive of the second cassette motor 506 so as to convey the jammed sheet P1 (S43). The CPU 301 causes the second cassette motor 506 to rotate the second separation rollers 156, to thereby convey the jammed sheet P1 toward the conveyance path opened by the lower door 260. The CPU 301 determines whether the jammed sheet P1 has been conveyed by the forced-conveying amount (Z2−X2) or not (S44). The CPU 301 waits until the conveyance of the lammed sheet P1 by the forced-conveying amount (Z2−X2) is completed ("NO" in S44). When the CPU 301 determines that the jammed sheet P1 has been conveyed by the forced conveying amount (Z2−X2) ("YES" in S44), the CPU 301 stops the drive of the second cassette motor 506 (S45). The CPU 301 ends the jammed-sheet forced-conveying control.

When the jammed sheet P1 is not the sheet fed from the second sheet feed cassette 150 ("NO" in S42), the CPU 301 determines whether the jammed sheet P1 is the sheet fed from the first sheet feed cassette 220 or not (S46). When the jammed sheet P1 is the sheet fed from the first sheet feed cassette 220 ("YES" in S46), the CPU 301 starts the drive of the first cassette motor 505 so as to convey the jammed sheet P1 (247). The CPU 301 causes the first cassette motor 505 to rotate the first separation rollers 226, to thereby convey the jammed sheet P1 toward the conveyance path opened by the lower door 260. The CPU 301 determines whether the jammed sheet P1 has been conveyed by the forced-conveying amount (Z1−X1) or not (S48). The CPU 301 waits until the conveyance of the jammed sheet 21 by the forced-conveying amount (Z1−X1) is completed ("NO" in S48). When the CPU 301 determines that the jammed sheet P1 has been conveyed by the forced-conveying amount (Z1−X1) ("YES" in S'18) the CPU 301 stops the drive of the first cassette motor 505 (S49). The CPU 301 ends the jammed-sheet forced-conveying control. The first cassette motor 505 and the first separation rollers 226 each serve as a conveyance unit configured to convey the jammed sheet P1 to the first portion 210.

When the jammed sheet P1 is not the sheet fed from the first sheet feed cassette 220 ("NO" in S46), the CPU 301 ends the jammed-sheet forced-conveying control.

Note that, even when the upper door 261 is opened before the determination in Step S41 that the lower door 260 opened, there is no influence on the forced-conveying control associated with the operation of opening the lower door 260, and hence the determination of whether the lower door 260 is opened or not is continued.

Next, referring to FIG. 9, the jammed-sheet forced-conveying control to be performed when the upper door 261 is to be opened will be described. When it is determined that X1≤Z11 is satisfied in Step S14 of FIG. 5 and the screen for prompting the user to open the upper door 261 is displayed in Step S17 of FIG. 5, the jammed-sheet forced-conveying control illustrated in FIG. 9 is started. The CPU 301 executes the jammed-sheet forced-conveying control based on the program stored in the ROM 302. When the leading edge of the jammed sheet P1 is located at the position satisfying CPU 301 determines whether the upper door open/close sensor 242 configured to detect the opening or closing of the upper door 261 is turned OFF or not (S51). The upper door open/close sensor 242 is formed of a push switch. When the upper door open/close sensor 242 is turned ON, the CPU 301 determines that the upper door 261 is closed. When the upper door open/close sensor 242 is turned OFF, the CPU 301 determines that the upper door 261 is opened. That is, in Step S51, the CPU 301 determines whether the upper door 261 is opened or not. The CPU 301 waits until the upper door 261 is opened ("NO" in S51).

When the upper door 261 is opened ("YES" in S51), the CPU 301 determines whether the jammed sheet P1 is the sheet fed from the first sheet feed cassette 220 or not (S52). When the jammed sheet P1 is the sheet fed from the first sheet feed cassette 220 ("YES" in S52), the CPU 301 starts the drive of the first cassette motor 505 and the conveyance motor 507 so as to convey the jammed sheet P1 (S53). The CPU 301 causes the first cassette motor 505 to rotate the first separation rollers 226 and causes the conveyance motor 507 to rotate the conveyance rollers 154, to thereby convey the jammed sheet P1 toward the conveyance path opened by the upper door 261. The CPU 301 determines whether the jammed sheet P1 has been conveyed by the forced-conveying amount (Z11−X1+R1) or not (S54). The CPU 301 waits until the conveyance of the jammed sheet P1 by the forced-conveying amount (Z11−X1+R1) is completed ("NO" in S54). When the CPU 301 determines that the jammed sheet P1 has been conveyed by the forced-conveying amount (Z11−X1+R1) ("YES" in S54), the CPU 301 stops the drive of the conveyance motor 507 (S55). The CPU 301 ends the jammed-sheet forced-conveying control. The first cassette motor 505, the first separation rollers 226, the conveyance motor 507, and the conveyance rollers 154 each serve as a conveyance unit configured to convey the jammed sheet P1 to the second portion 211.

When the jammed sheet P1 is not the sheet fed from the first sheet feed cassette 220 ("NO" in S52), the CPU 301 does not perform the forced conveyance of the jammed sheet P1. The CPU 301 ends the jammed-sheet forced-conveying control.

Note that, when the lower door 260 is opened at the time of forced conveyance of the jammed sheet P1 in response to the opening of the upper door 261, the jammed sheet P1 cannot be conveyed by t conveyance rollers 154. Thus, a screen for prompting the user to close the lower door 260 may be displayed on the UI 330.

According to the embodiment, based on the position of the jammed sheet P1 before the lower door 260 or the upper door 261 is opened, determination is performed as to whether not to convey the jammed sheet P1, whether to convey the jammed sheet P1 toward the first portion to be opened by the lower door 260, or whether to convey the jammed sheet P1 toward the second portion to be opened by the upper door 261. Thus, in association with the door opening operation to be displayed on the display portion 340, the jammed sheet P1 can be conveyed to the position from which the user can easily remove the jammed sheet P1. The door for discharging the jammed sheet P1 is selected based on the stop position of the jammed sheet P1, and hence the jammed sheet P1 can be prevented from entering the conveyance path of the unopened door even when the jammed-sheet forced-conveying control is performed. According to the embodiment, the easiness of the jam clearance by the user can be enhanced.

According to the embodiment, the stopped sheet can be conveyed to the position from which the user can easily remove the stopped sheet.

Second Embodiment

Now, a second embodiment will be described. In the second embodiment, the same structural elements as those of the first embodiment are represented by the same reference symbols, and description thereof is therefore omitted herein. In the second embodiment, the image forming apparatus, the image forming operation, the jam detection, and the determination of whether the jammed-sheet forced-conveying control is performed or not are the same as those of the first embodiment, and description thereof is therefore omitted herein. The jammed-sheet forced-conveying control of the second embodiment is different from that of the first embodiment, and hence this difference will be described below.

(Jammed-Sheet Forced-Conveying Control)

When the CPU 301 determines to perform the jammed-sheet forced-conveying control (S5, S12, or S16 of FIG. 5), the CPU 301 displays, on the display portion 340, the screen for prompting the user to open the lower door 260 or the upper door 261 (S6, S13, or S17 of FIG. 5). In the first embodiment, when the lower door 260 or the upper door 261 displayed on the display portion 340 is opened ("YES" in S41 of FIG. 8 or "YES" in S51 of FIG. 9), the conveyance of the jammed sheet P1 is started (S43 or S47 of FIG. 8 or S53 of FIG. 9). In the second embodiment, when the door for opening a portion that is not the open portion of the conveyance path on which the jammed sheet P1 is to be conveyed is opened, the conveyance of the jammed sheet P1 is not performed.

Figure 10:
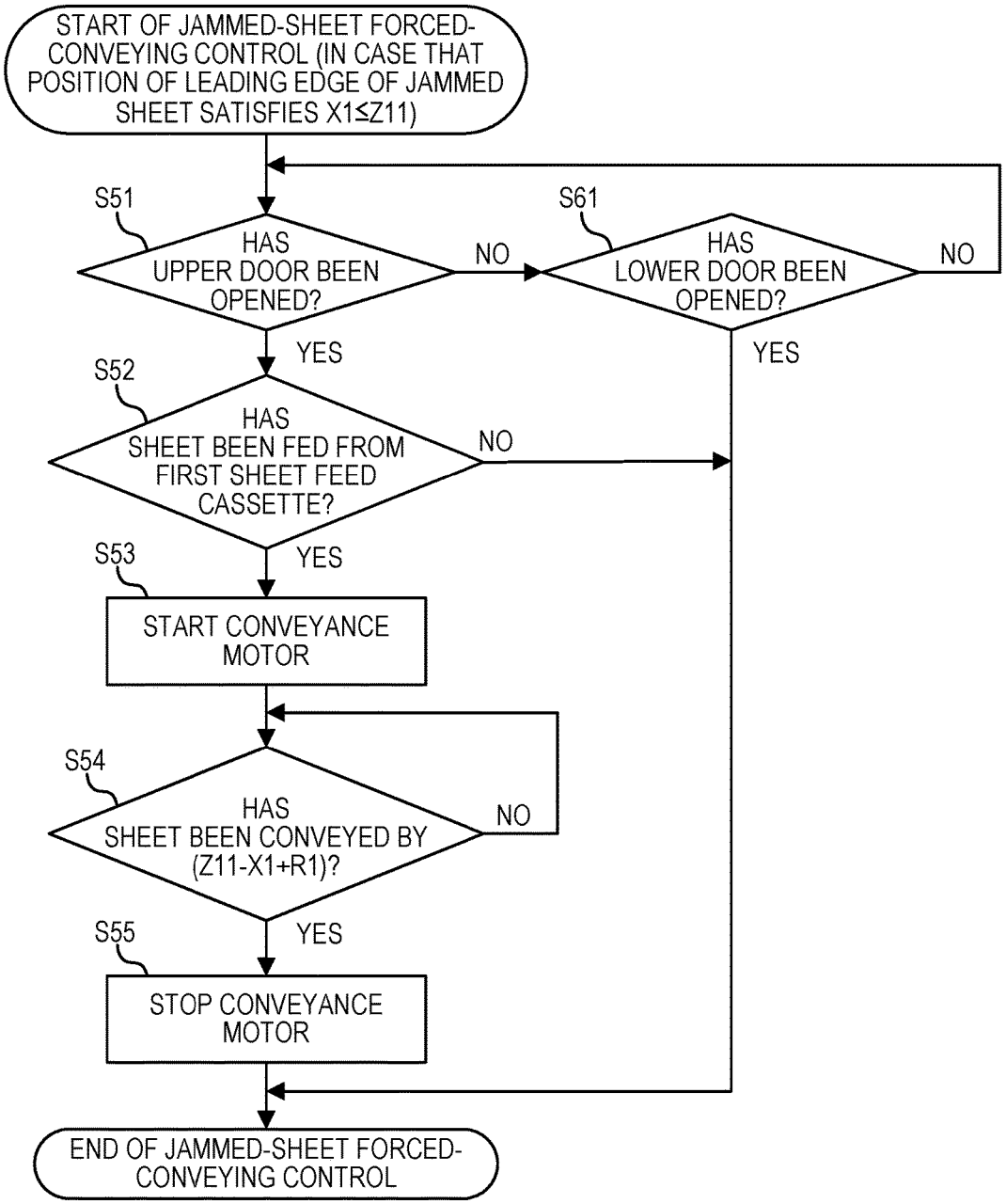
FIG. 10 is a flowchart of jammed-sheet forced-conveying control to be performed when the upper door is to be opened according to a second embodiment.
Figure 11A:
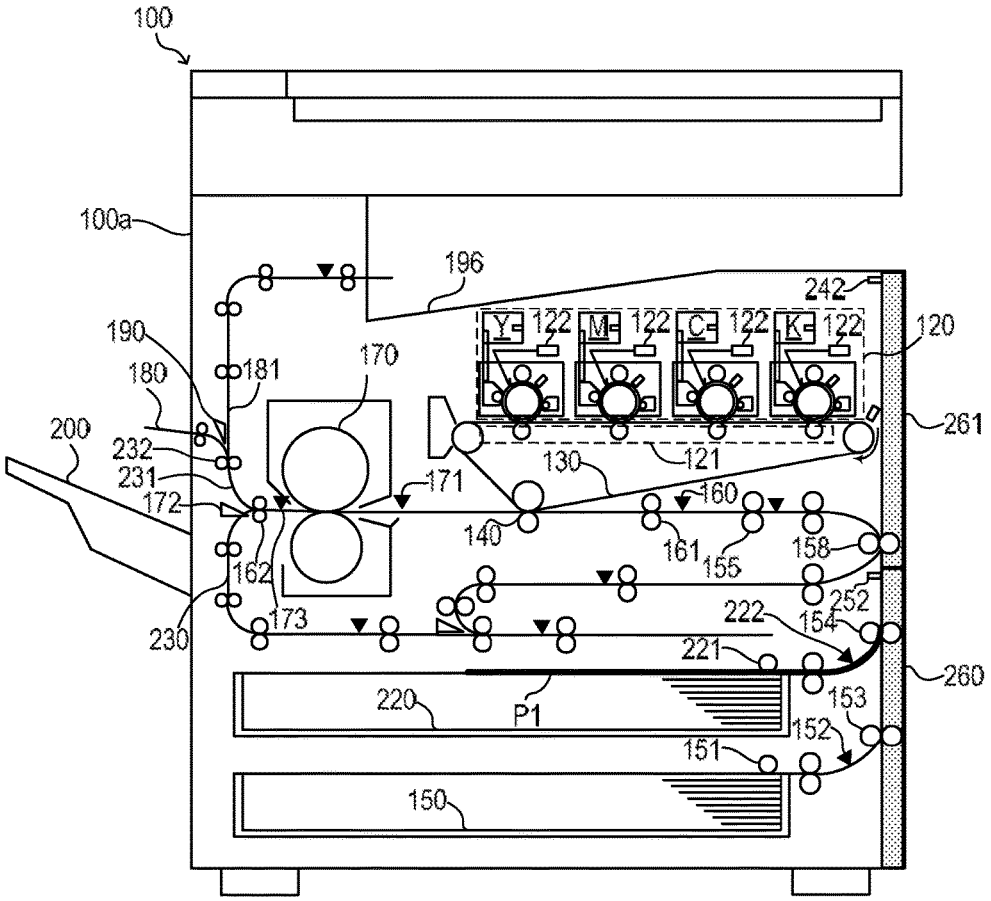
PRIOR ART FIG. 11A
FIGS. 11A and 11B are explanatory views of jammed sheets in the inside of an image forming apparatus.
Figure 11B:
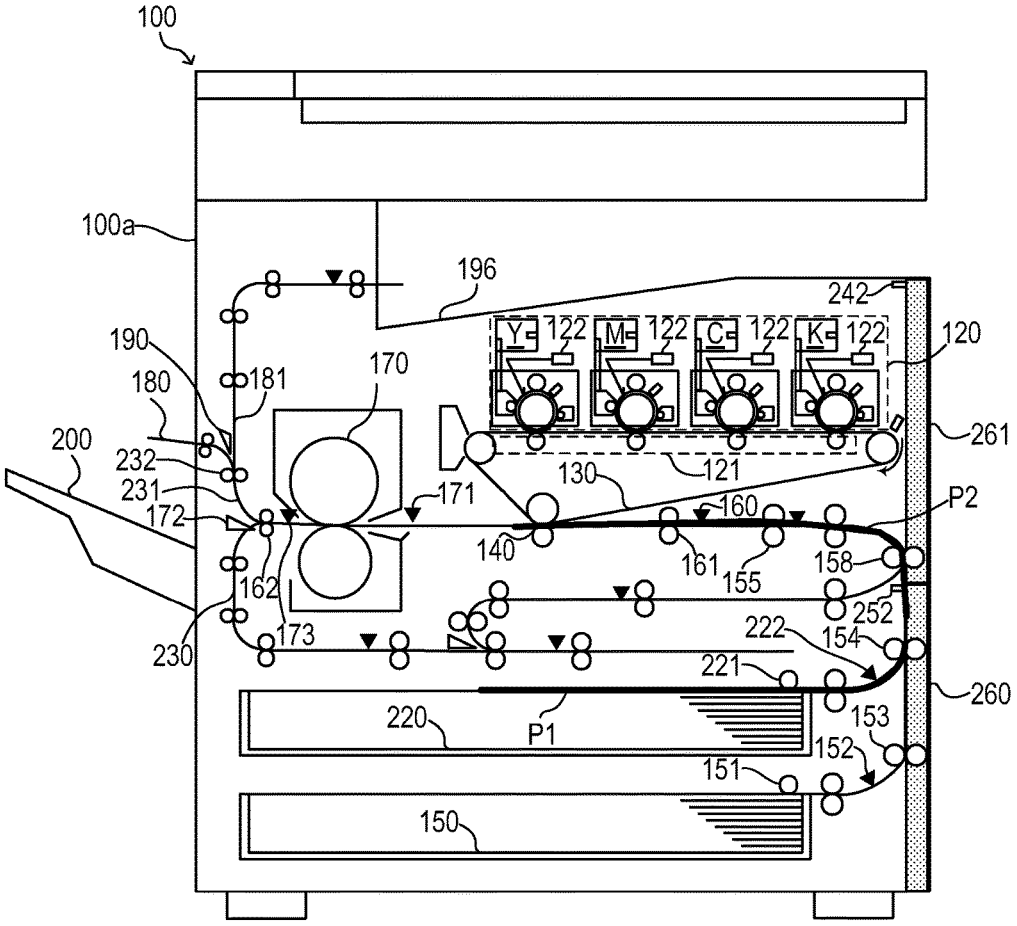
PRIOR ART FIG. 11B
Figure 12A:
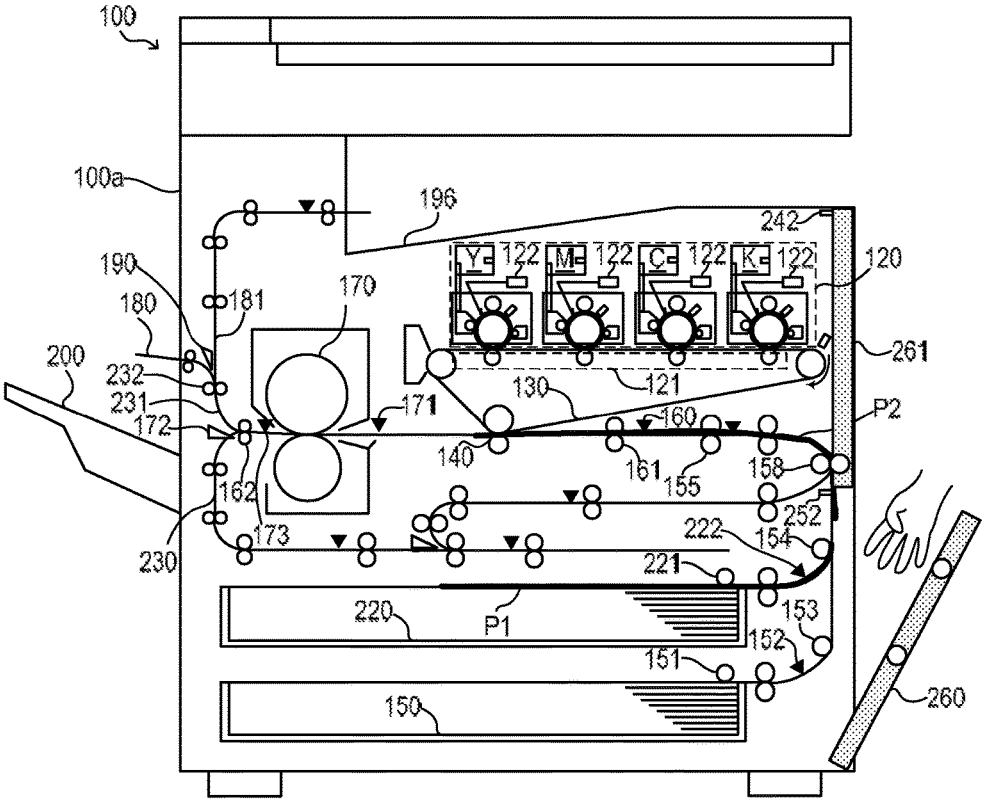
PRIOR ART FIG. 12A
FIGS. 12A, 12B and 12C are explanatory views of forced conveyance of a jammed sheet in the related art.
Figure 12B:
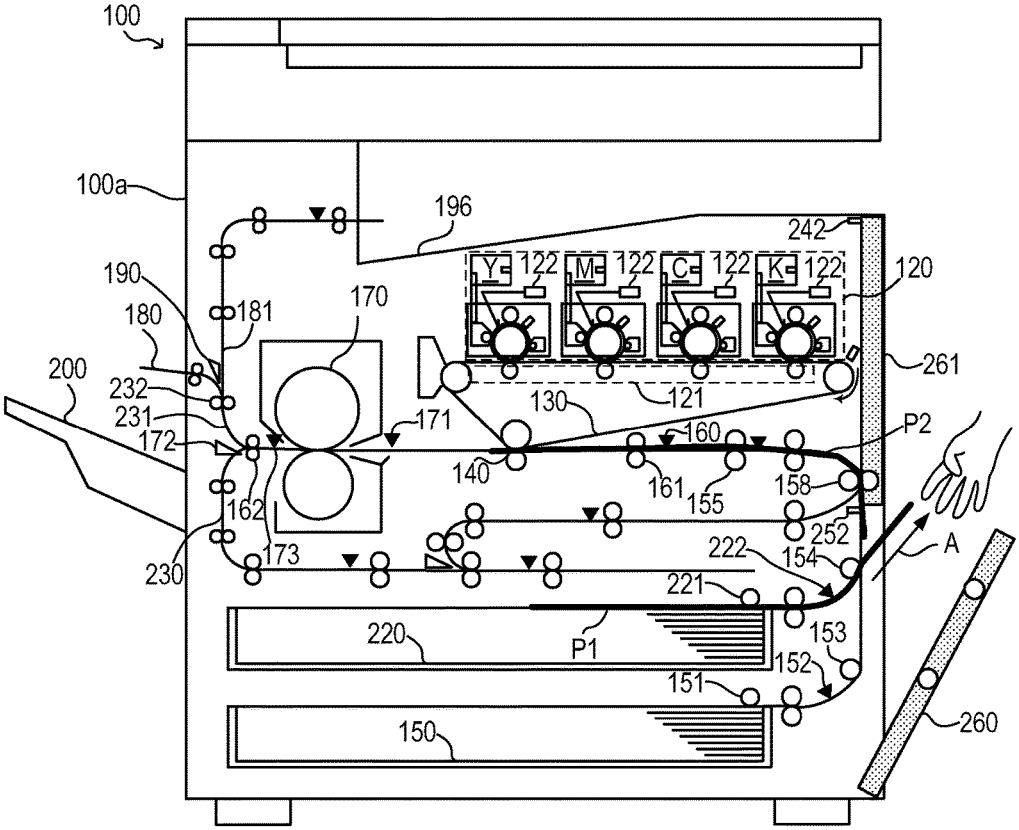
PRIOR ART FIG. 12B
Figure 12C:
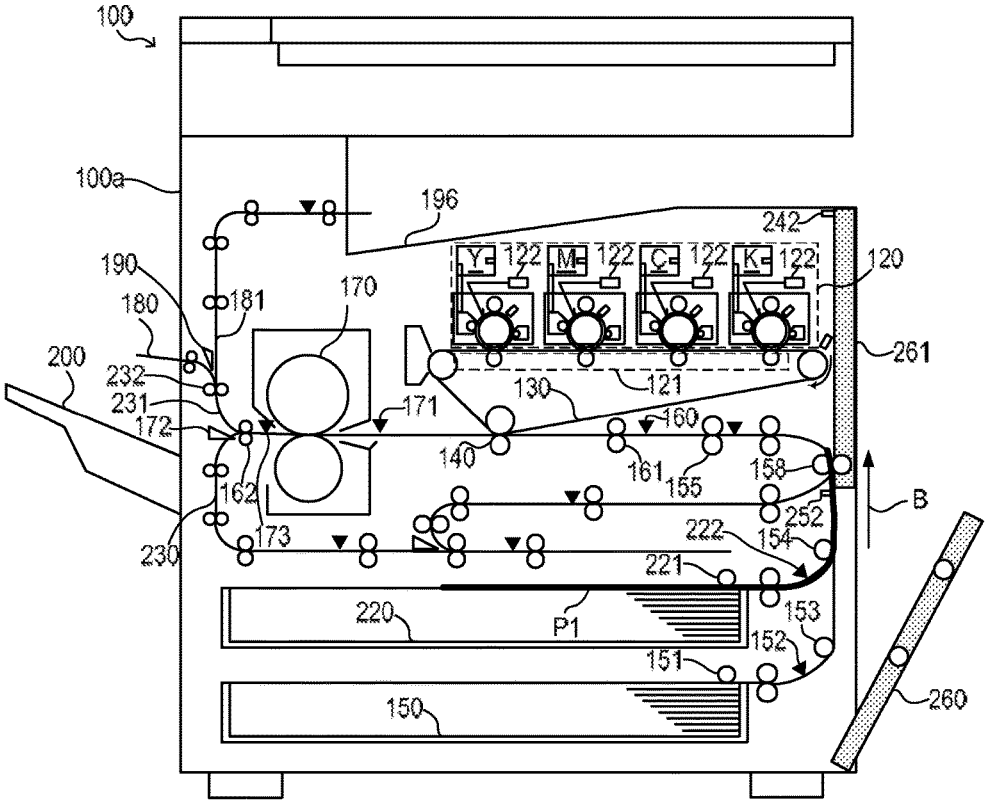
PRIOR ART FIG. 12C

Referring to FIG. 10, the jammed-sheet forced-conveying control of the second embodiment will be described. FIG. 10 is a flowchart of the jammed-sheet forced-conveying control to be performed when the upper door 261 is to be opened according to the second embodiment.

Referring to FIG. 10, the jammed-sheet forced-conveying control to be performed when the upper door 261 is to be opened according to the second embodiment will be described. When it is determined that X1≤Z11 is satisfied in Step S14 of FIG. 5 and the screen for prompting the user to open the upper door 261 is displayed in Step S17 of FIG. 5, the jammed-sheet forced-conveying control illustrated in FIG. 10 is started. The CPU 301 executes the jammed-sheet forced-conveying control based on the program stored in the ROM 302. When the leading edge of the jammed sheet P1 is located at the position satisfying X1≤Z11, the CPU 301 determines whether the upper door open/close sensor 242 configured to detect the opening or closing of the upper door 261 is turned OFF or not (S51). Step S52 to Step S55 to be executed by the CPU 301 when the upper door 261 is opened ("YES" in S51) are the same as those illustrated in FIG. 9 according to the first embodiment, and description thereof is therefore omitted herein.

When the upper door 261 is not opened ("NO" in S51), the CPU 301 determines whether the lower door open/close sensor 252 configured to detect the opening or closing of the lower door 260 is turned OFF or not (S61). That is, in Step S61, the CPU 301 determines whether the lower door 260 is opened or not. When the lower door 260 is not opened ("NO" in S61), the CPU 301 returns to Step S51. When the lower door 260 is opened ("YES" in S61), the CPU 301 ends the jammed-sheet forced-conveying control. Thus, when the lower door 260 is opened, the forced conveyance is not performed even though the upper door 261 is opened afterwards. The reason why the forced conveyance is halted when the door for opening a portion other than the open portion of the conveyance path through which the jammed sheet P1 is to be conveyed is opened after the CPU 301 has decided the open portion based on the position of the leading edge of the jammed sheet P1 will be described below. When the lower door 260 is opened without opening the upper door 261, the posture or state of the jammed sheet P1 may be chanced. When the conveyance of the jammed sheet P1 is started in this state in association with the operation of opening the upper door 261, skew feeding of the jammed sheet P1 may occur. In this case, the user may feel difficult to remove the jammed sheet P1 from the main body 100*a*. For this reason, the forced-conveying control is prevented from being started in association with the opening of the door for a portion other than the open portion through which the sheet is to be conveyed by the forced-conveying control.

According to the second embodiment, when the operation of opening the door other than the door decided by the CPU 301 is detected, the jammed sheet P1 can be prevented from being conveyed by the forced conveyance in a state in which it is difficult to remove the jammed sheet P1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-010848, filed Jan. 23, 2015, which is hereby incorporated by reference herein in its entirety.

What is claimed is:

1. An image forming apparatus, comprising:

a conveyance unit configured to convey a sheet on a conveyance path on which the sheet is conveyed;

a first conveyance path opening member configured to open a first portion of the conveyance path by the first conveyance path opening member being opened to allow a sheet to be removed from the first portion;

a second conveyance path opening member configured to open a second portion downstream of the first portion of the conveyance path in a sheet conveyance direction by the second conveyance path opening member being opened to allow a sheet to be removed from the second portion;

a sheet leading edge position detecting unit configured to detect a position of a leading edge of a stopped sheet on the conveyance path; and a determination unit configured to determine, based on a detection result of the sheet leading edge position detecting unit, one of not conveying the stopped sheet, causing the conveyance unit to convey the stopped sheet toward the first portion, and causing the conveyance unit to convey the stopped sheet toward the second portion, wherein, in a case where the determination unit determines to cause the conveyance unit to convey the stopped sheet toward the first portion, the conveyance unit starts to convey the stopped sheet in association with an operation of opening the first conveyance path opening member, and wherein, in a case where the determination unit determines to cause the conveyance unit to convey the stopped sheet toward the second portion, the conveyance unit starts to convey the stopped sheet in association with an operation of opening the second conveyance path opening member.

2. An image forming apparatus according to claim 1, further comprising a display portion configured to:

display, in the case where the determination unit determines to cause the conveyance unit to convey the stopped sheet toward the first portion, a screen for prompting a user to open the first conveyance path opening member; and display, in the case where the determination unit determines to cause the conveyance unit to convey the stopped sheet toward the second portion, a screen for prompting the user to open the second conveyance path opening member.

3. An image forming apparatus according to claim 1, further comprising a conveying amount deciding portion configured to decide, based on the detection result of the sheet leading edge position detecting unit, a conveying amount by which the conveyance unit conveys the stopped sheet.

4. An image forming apparatus according to claim 1, further comprising a jam detector configured to detect that a sheet being conveyed by the conveyance unit is jammed on the conveyance path, wherein, in a case where the jam detector detects that the sheet is jammed, conveyance of the sheet by the conveyance unit is stopped.

5. An image forming apparatus according to claim 1, wherein, in the case where the determination unit determines to cause the conveyance unit to convey the stopped sheet toward the second portion, the conveyance unit does not convey the stopped sheet when the first conveyance path opening member is opened.

6. An image forming apparatus according to claim 5, wherein, the conveyance unit does not convey the stopped sheet even when the second conveyance path opening member is opened after the first conveyance path opening member is opened.

7. An image forming apparatus according to claim 1, wherein the sheet leading edge position detecting unit comprises a sheet sensor configured to detect a presence or absence of the sheet at a predetermined position on the conveyance path, and wherein the sheet leading edge position detecting unit is configured to detect the position of the leading edge of the sheet based on a conveyance time from a time when the sheet sensor detects the presence of the sheet from the absence of the sheet.

8. An image forming apparatus, comprising:

a conveyance unit configured to convey a sheet on a conveyance path on which the sheet is conveyed;

a first door configured to open a first portion of the conveyance path by the first door being opened to allow a sheet to be removed from the first portion;

a second door configured to open a second portion downstream of the first portion of the conveyance path in a sheet conveyance direction by the second door being opened to allow a sheet to be removed from the second portion;

a sheet detector configured to detect a sheet on the conveyance path;

a jam detector configured to detect jamming of a sheet; and a controller configured to determine a position of a sheet based on a detection result of the sheet detector in a case where the jamming of the sheet is detected by the jam detector, and to determine, based on a determined position of the sheet, one of not conveying the sheet, causing the conveyance unit to convey the sheet toward the first portion, and causing the conveyance unit to convey the sheet toward the second portion, wherein, in a case where the controller determines to cause the conveyance unit to convey the sheet toward the first portion, when the first door is opened, the controller controls the conveyance unit to convey the sheet so that the sheet is removed from the first portion which is opened, and wherein, in a case where the controller determines to cause the conveyance unit to convey the sheet toward the second portion, when the second door is opened, the controller controls the conveyance unit to convey the sheet so that the sheet is removed from the second portion which is opened.

9. An image forming apparatus according to claim 8, further comprising a display portion configured to:

display, in the case where the controller determines to cause the conveyance unit to convey the sheet toward the first portion, a screen for prompting a user to open the first door; and display, in the case where the controller determines to cause the conveyance unit to convey the sheet toward the second portion, a screen for prompting the user to open the second door.

10. An image forming apparatus according to claim 8, wherein, in the case where the controller determines to cause the conveyance unit to convey the sheet toward the first portion, the controller determines, based on the determined position of the sheet, a conveying amount of the sheet to be conveyed after the first door is opened, and wherein, in the case where the controller determines to cause the conveyance unit to convey the sheet toward the second portion, the controller determines, based on the determined position of the sheet, a conveying amount of the sheet to be conveyed after the second door is opened.

11. An image forming apparatus according to claim 8, wherein, in the case where the controller determines to cause the conveyance unit to convey the sheet toward the second portion, even if the first door is opened, the controller controls the conveyance unit not to convey the sheet.

12. An image forming apparatus according to claim 11, wherein, even if the second door is opened after the first door is opened, the controller controls the conveyance unit not to convey the sheet.

13. An image forming apparatus according to claim 8, wherein the controller determines the position of the sheet based on a conveyance time from a time when the sheet detector detects the presence of the sheet from the absence of the sheet.

14. An image forming apparatus, comprising:

a conveyance unit configured to convey a sheet on a conveyance path on which the sheet is conveyed;

a door configured to open a predetermined portion of the conveyance path by the door being opened to allow a sheet to be removed from the predetermined portion;

a door detector configured to detect opening and closing of the door;

a sheet detector, which is located upstream of the predetermined portion in a sheet conveyance direction, configured to detect a sheet on the conveyance path;

a jam detector configured to detect jamming of a sheet; and a controller configured to determine not to convey a jammed sheet after the door is opened if a distance between the sheet detector and a leading edge of the jammed sheet is equal to or more than a predetermined distance, and determine to convey the jammed sheet to the predetermined portion when the door is opened if the distance between the sheet detector and the leading edge of the jammed sheet is less than the predetermined distance, in a case where the jamming of the sheet is detected by the jam detector, wherein, in a case where the controller determines to cause the conveyance unit to convey the sheet toward the predetermined portion, when the opening of the door is detected by the door detector, the controller controls the conveyance unit to convey the sheet so that the sheet is removed from the predetermined portion which is opened.

15. An image forming apparatus according to claim 14, wherein the controller determines, based on the determined position of the sheet, a conveying amount of the sheet to be conveyed after the door is opened.

16. An image forming apparatus according to claim 14, wherein the controller determines the position of the sheet based on a conveyance time from a time when the sheet detector detects the presence of the sheet from the absence of the sheet.

* * * * *